US008205950B1

(12) United States Patent
Bockheim et al.

(10) Patent No.: US 8,205,950 B1
(45) Date of Patent: Jun. 26, 2012

(54) WORKSTATION UNIT WITH VERTICALLY MOVABLE PANEL

(75) Inventors: Robert J. Bockheim, Grand Rapids, MI (US); Joel T. Ruiter, Grand Rapids, MI (US)

(73) Assignee: Nucraft Furniture Company, Comstock Park, MI (US)

( * ) Notice: Subject to any disclaimer, the term of this patent is extended or adjusted under 35 U.S.C. 154(b) by 428 days.

(21) Appl. No.: 12/479,098

(22) Filed: Jun. 5, 2009

Related U.S. Application Data

(60) Provisional application No. 61/059,458, filed on Jun. 6, 2008.

(51) Int. Cl.
*A47B 95/00* (2006.01)

(52) U.S. Cl. ..... 312/306; 312/223.6

(58) Field of Classification Search ..... 312/304, 312/306, 312, 223.3, 223.6, 307
See application file for complete search history.

(56) References Cited

U.S. PATENT DOCUMENTS

| | | | | | |
|---|---|---|---|---|---|
| 1,144,398 | A | | 6/1915 | Thommen | |
| 1,688,456 | A | | 10/1928 | Dolph | |
| 2,258,948 | A | * | 10/1941 | Garrison | 312/110 |
| 2,323,107 | A | * | 6/1943 | Wilson | 312/310 |
| 2,354,106 | A | | 7/1944 | Cooper | |
| 2,654,650 | A | | 10/1953 | Stanton | |
| 3,066,993 | A | | 12/1962 | Mark | |
| 3,290,108 | A | | 12/1966 | Beckman et al. | |
| 3,761,152 | A | | 9/1973 | Cory | |
| 3,828,695 | A | | 8/1974 | Skarky | |
| 3,883,202 | A | * | 5/1975 | Konig | 312/223.6 |
| 4,180,298 | A | | 12/1979 | Borgerson, Jr. et al. | |
| 4,217,832 | A | | 8/1980 | Pozzan | |
| 4,685,255 | A | * | 8/1987 | Kelley | 52/36.1 |
| 4,735,467 | A | | 4/1988 | Wolters | |
| 4,922,835 | A | | 5/1990 | Van Vliet et al. | |
| 4,948,205 | A | * | 8/1990 | Kelley | 312/196 |
| 5,071,204 | A | | 12/1991 | Price et al. | |
| 5,195,713 | A | | 3/1993 | Van Dore et al. | |
| 5,255,966 | A | * | 10/1993 | Newhouse et al. | 312/107 |
| 5,328,260 | A | * | 7/1994 | Beirise | 312/223.6 |
| 5,394,658 | A | * | 3/1995 | Schreiner et al. | 52/36.1 |
| 5,429,431 | A | * | 7/1995 | Olson et al. | 312/223.6 |
| D384,846 | S | | 10/1997 | Zaidman et al. | |
| 5,694,862 | A | * | 12/1997 | Grubb | 108/50.11 |
| 5,718,179 | A | | 2/1998 | Johnson et al. | |
| D391,782 | S | | 3/1998 | Neufeld | |
| 5,794,545 | A | | 8/1998 | McDaniel et al. | |
| D403,878 | S | | 1/1999 | Zaidman | |
| 5,924,780 | A | * | 7/1999 | Ammon et al. | 312/223.2 |
| 6,126,253 | A | | 10/2000 | Kelley et al. | |

(Continued)

*Primary Examiner* — Hanh V Tran
(74) *Attorney, Agent, or Firm* — Gardner, Linn, Burkhart & Flory, LLP

(57) ABSTRACT

A work station unit includes a storage area for storing project files at or near a work surface, and a movable cover panel that is vertically movable between an opened position, where at least a portion of the storage area is exposed and accessible for accessing the stored project files, and a closed position, where the storage area is at least substantially concealed by the movable cover panel. The work station unit may include a fixed cover panel over a lower portion of the storage area to at least partially conceal hanging folders and the like at the workstation unit. The movable cover panel may conceal the open area of the storage area when in its closed position and the movable cover panel may at least partially overlap the fixed cover panel when the movable cover panel is in its opened position.

20 Claims, 26 Drawing Sheets

U.S. PATENT DOCUMENTS

| | | | | |
|---|---|---|---|---|
| 6,182,581 | B1 | 2/2001 | Boyce | |
| 6,283,043 | B1 | 9/2001 | Stern et al. | |
| 6,327,983 | B1 | 12/2001 | Cronk et al. | |
| 6,457,422 | B1 * | 10/2002 | Saul | 108/50.02 |
| 6,497,184 | B1 | 12/2002 | Whitesitt | |
| D476,178 | S | 6/2003 | Schacht et al. | |
| D476,503 | S | 7/2003 | Chesser et al. | |
| D476,514 | S | 7/2003 | Chesser et al. | |
| 6,588,346 | B1 | 7/2003 | Bockheim et al. | |
| 6,615,551 | B2 | 9/2003 | Chesser et al. | |
| 6,725,784 | B2 | 4/2004 | Crinion | |
| D492,150 | S | 6/2004 | Chesser et al. | |
| 6,854,217 | B2 | 2/2005 | Bockheim et al. | |
| D542,296 | S | 5/2007 | Bockheim et al. | |
| D576,421 | S | 9/2008 | Grabowski et al. | |
| D576,422 | S | 9/2008 | Grabowski et al. | |
| D577,509 | S | 9/2008 | Grabowski et al. | |
| D579,229 | S | 10/2008 | De La Serve et al. | |
| D587,033 | S | 2/2009 | Martin et al. | |
| D591,979 | S | 5/2009 | Singler et al. | |
| 2005/0189851 | A1 * | 9/2005 | Martin et al. | 312/196 |
| 2005/0268823 | A1 | 12/2005 | Bakker et al. | |
| 2006/0042520 | A1 | 3/2006 | Stevens et al. | |
| 2006/0179458 | A1 | 8/2006 | Schmieder et al. | |

* cited by examiner

WORKSTATION UNIT WITH VERTICALLY MOVABLE PANEL

CROSS REFERENCE TO RELATED APPLICATION

The present claims the benefit of U.S. provisional application Ser. No. 61/059,458, filed Jun. 6, 2008, which is hereby incorporated herein by reference in its entirety.

FIELD OF THE INVENTION

The present invention relates generally to office furniture and, more particularly, to work stations and desks and shelving arrangements for offices.

BACKGROUND OF THE INVENTION

Typical office desks and credenzas provide a work surface on which a person may spread out their work while working on a project. However, other work documents relating to other projects are typically stacked on the work surface, often getting in the way of the project presently being worked on. In some cases, the other work documents may be stored in a cabinet or file drawer remote from the work surface, whereby it may be inconvenient for the worker to access the other documents when it is time to work on them.

SUMMARY OF THE INVENTION

The present invention provides a workstation unit that has a work storage area for storing files and the like, wherein the files may be readily hidden from view or accessed via a movable cover panel that is vertically movable along a front region of the workstation unit, and wherein the files may be readily accessible at or near the work surface by opening the movable cover panel.

According to an aspect of the present invention, a work station unit includes a work surface, a storage area for storing project files at or near the work surface, and a movable cover panel that is vertically movable between an opened position, where at least a portion of the storage area is exposed and accessible for accessing the stored project files, and a closed position, where the storage area is at least substantially concealed by the movable cover panel.

Optionally, and in accordance with another aspect of the present invention, a work station assembly may include a work surface comprising a generally horizontal work surface, and a workstation unit having a storage area for storing project files along and generally adjacent to a perimeter edge region of the work surface, a fixed cover panel over a lower portion of the storage area, and a movable cover panel. The storage area is configured to support project items within the workstation unit and has an upper portion of the storage area above the stored project items (such as hanging files or the like suspended or otherwise disposed at the lower portion of the storage area). The fixed cover panel at least partially conceals the project items supported at the storage area and disposed at the lower portion of the storage area. The movable cover panel is vertically movable between an opened position, where at least a portion of the upper portion of the storage area is exposed and wherein the project items supported at the storage area are accessible by a user of the work station unit, and a closed position, where the upper portion of the storage area is at least substantially concealed by the cover panel.

Optionally, the movable cover panel conceals the upper portion of the storage area when in the closed position and the movable cover panel at least partially overlaps the fixed cover panel when the movable cover panel is in the opened position. Optionally, an upper edge region of the fixed cover panel is at a level that is above a level of the work surface. Optionally, the workstation unit includes an open storage area below the fixed cover panel, and the open storage area is not closed by the movable cover panel in either of the opened and closed positions. Optionally, accessory supports may be provided for supporting accessories at the upper portion of the storage area and within the workstation unit. Optionally, the work station assembly and/or the workstation unit may include a wire management portion at or below the storage area of the workstation unit.

These and other objects, advantages, purposes and features of the present invention will become apparent upon review of the following specification in conjunction with the drawings.

DESCRIPTION OF THE PREFERRED EMBODIMENTS

Figure 1A:
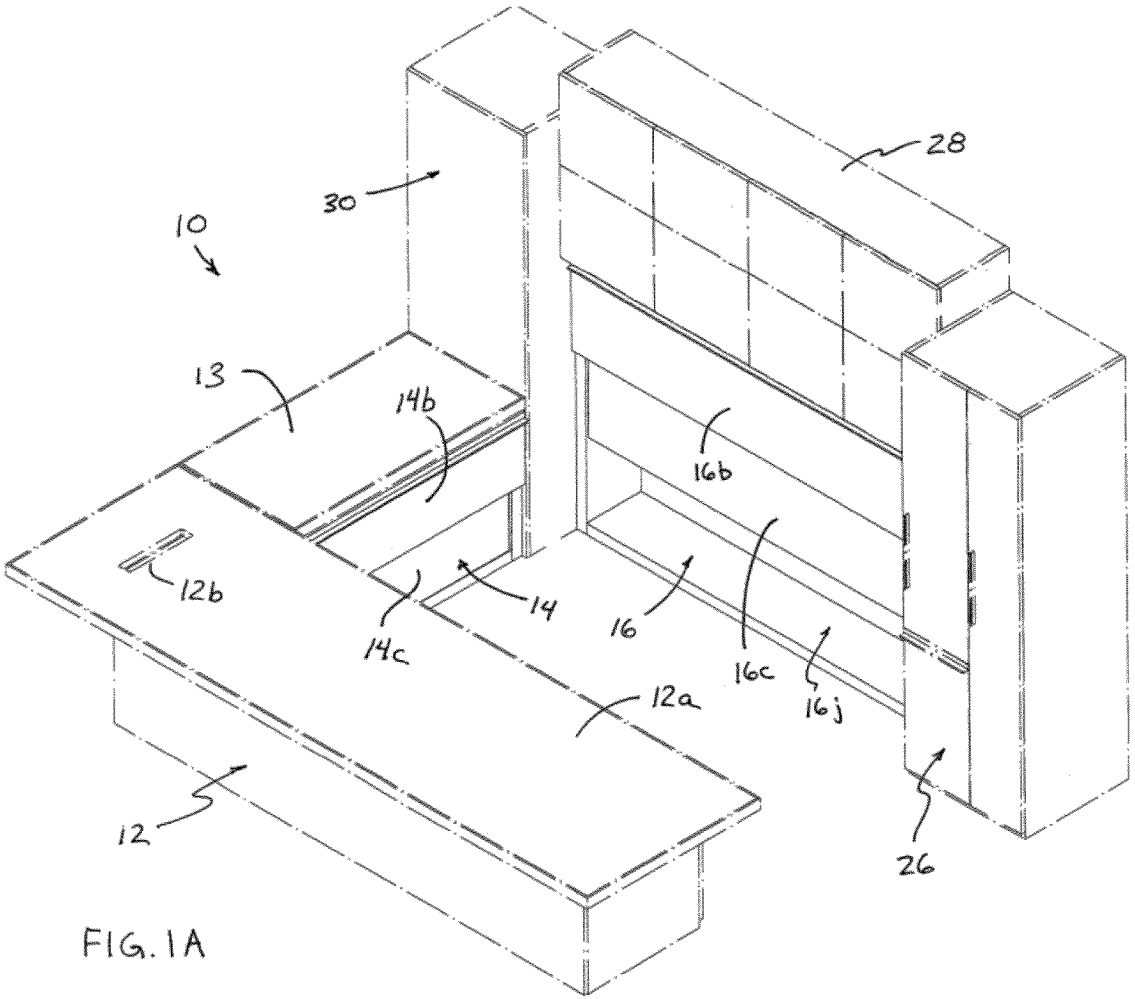
FIGS. 1A and 1B are perspective views of a workstation unit of an office furniture arrangement in accordance with the present invention.

Referring now to the drawings and the illustrative embodiments depicted therein, a wall storage and workplace unit is suitable for a desk or work station environment and allows the user to work at a work surface and to close or conceal the storage area and stored documents or work projects when the person is not at work (such as during a meeting in the office where it may be undesirable to have the work documents in view) or when the person is otherwise not working on the stored documents or projects. The storage area can be closed or concealed via a vertically movable or slidable door or panel that the user may readily move upward or downward to close or open the storage area or work-in-process area. The vertically movable door or panel allows the user to readily open and close or conceal the work-in-process area while the user is seated at or near the desk or wall unit, and thus provides enhanced usability over swing out doors and the like, as discussed below.

The workplace unit or workstation unit of the present invention provides multiple advantages and features including:

- an innovative wall with a vertical sliding door that keeps work-in-process close to the user with the ability to easily hide away the work files or folders or items when not in use;
- a clean, contemporary design with straight lines;
- an ability to mix wood and paint for a custom design aesthetics;
- an ability to morph from wall-based design to conventional casegood designs.

Historically, casegood design has been focused around paper-based office work, using desks and files to interact and store the paper and folders. As paper usage increased, overheads were created for additional storage of binders. Casegood design has morphed little to accommodate technology and its effect on our work styles. From the introduction of the personal computer to the influx of cell phones, PDA's and MP3 players, technology has been crammed into the existing casegood paradigm.

Technology is more than an add-on to work life, it has revolutionized people's entire lives. The workstation units of the present invention provide enhanced work stations for today's workers, who rely heavily on technology, instead of filed paper, to access, examine, manipulate and archive information. Moreover, private offices are often cluttered due to the fact that users tend to be "pilers" versus "filers". Pilers are reluctant to hide materials in files, because out of sight means out of mind. With long term storage in digital form, this reduces the need for the amount of archival storage (lateral files, file pedestals, overheads) around which conventional private offices have been designed. Work-in-process, often found in piles on or at or by a person's desk, needs to be readily accessible without looking cluttered; visible, but able to be locked away for security reasons.

The present invention supports and organizes the work-in-process paper through the development of the wall storage. The wall storage units or workstation units of the present invention may be available in various heights. The units provide a means by which the contents can be quickly accessed and easily hidden when not in use, creating a clutter free and secure work station. Wall storage units may even eliminate the need for a return work surface in the station. When a piling surface is still desired, the work station may include a small shelf or surface or panel in front of the wall storage unit, such as, for example, a 12 inch (or thereabouts) depth return shelf or the like, which works well mounted in front of wall storage units of the present invention.

Optionally, one or more storage pedestals may be provided closest to the user and may work well to organize all project specific folders in one centralized location. Optionally, one or more lateral files and pedestals may be provided to manage archival storage that may still be needed in paper form in the office. Optionally, overheads may be provided for those who cannot completely break free from the conventional casegood thinking and aesthetics.

In conventional private offices, small work surfaces limit productivity. Users end up working in cramped corners to reach power and data outlets. The desk or work surface of the work stations of the present invention becomes the user's "work bench", where individual and collaborative work happens. Users need to be able to spread work out, be able to conduct informal meetings and have immediate access to technology and work-in-process. The desks or wall units with a conference end may provide substantial work space and the ability for side-by-side collaboration, the position shown to enhance dyadic work. Large wire pass-throughs and the ability to manage power from the work surface to the wall unit remove cord clutter from the desk.

The wall units not only house technology, but are one of the means for routing power through the work station. Through an opening in the wall unit, users can access building power and data connections. Convenience outlets can be added through a power station or "PowerPup" outfitted to have power and data in the work tools area of the wall unit. Power and data cables are routed through the work surface grommet to the wire raceway in the wall unit. Power pedestals, printer pedestals and laptop/box/file pedestals provide additional ways to manage equipment in the private office.

The wall units work well to organize work-in-process paper flow as well as technology and accessories. They are fully utilized from top to bottom and may include a work-in-process zone, a wire management zone and an open-storage zone.

Work-in-Process Zone

This is the zone nearest to work surface height (and may extend above and below the level of the work surface, with the zone being accessible at a level above the work surface when the movable cover panel is opened or lowered, as discussed below) and may include pendaflex storage or hanging file storage, technology storage (such as an office phone/cell phone/PDA managed on work tools or supports which slide laterally above the pendaflex or hanging files), and vertical storage (such as magnetic surfaces, paper trays and/or the like). Everything located in this zone is capable of being quickly and easily customized, concealed and locked behind the innovative sliding door. Making work visible and easily accessible simplifies organization and helps users manage their day. This is a great solution for pilers who are reluctant to "hide" folders into file drawers.

Optionally, there may be two (or more) versions of work tools. For example, one version may be made of anodized aluminum and another may be made of solid wood with an aluminum bottom. Optionally, each wall unit may be outfitted with an LED light (or other illumination source) which illuminates the work tool zone (in the storage are or work-in-process zone). The light can be switched on and off manually, or it can be activated automatically based on position of the movable cover panel or door.

Wire Management Zone

Figure 12:
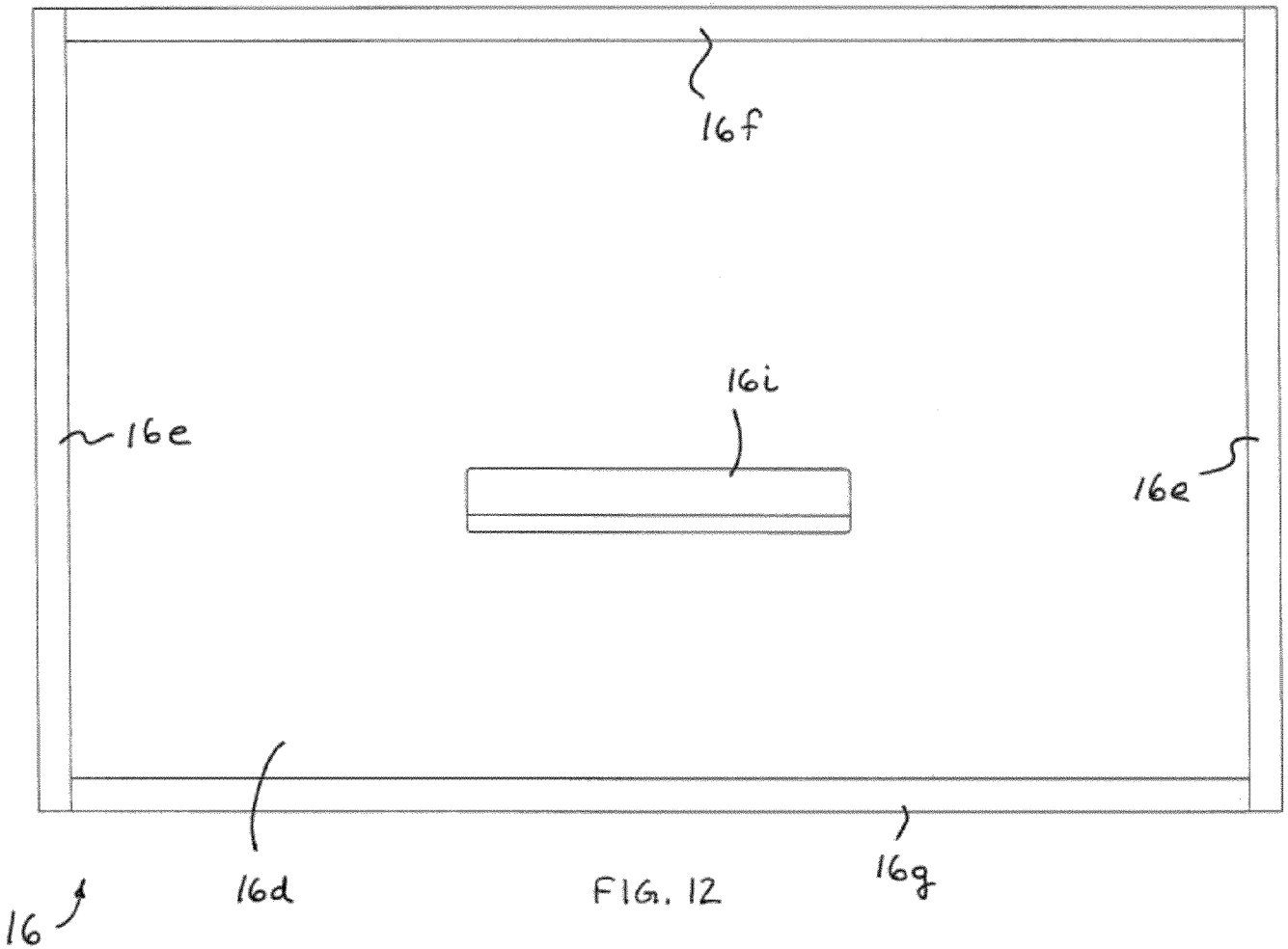
FIG. 12 is a rear elevation of the workstation unit of FIG. 10.
Figure 13:
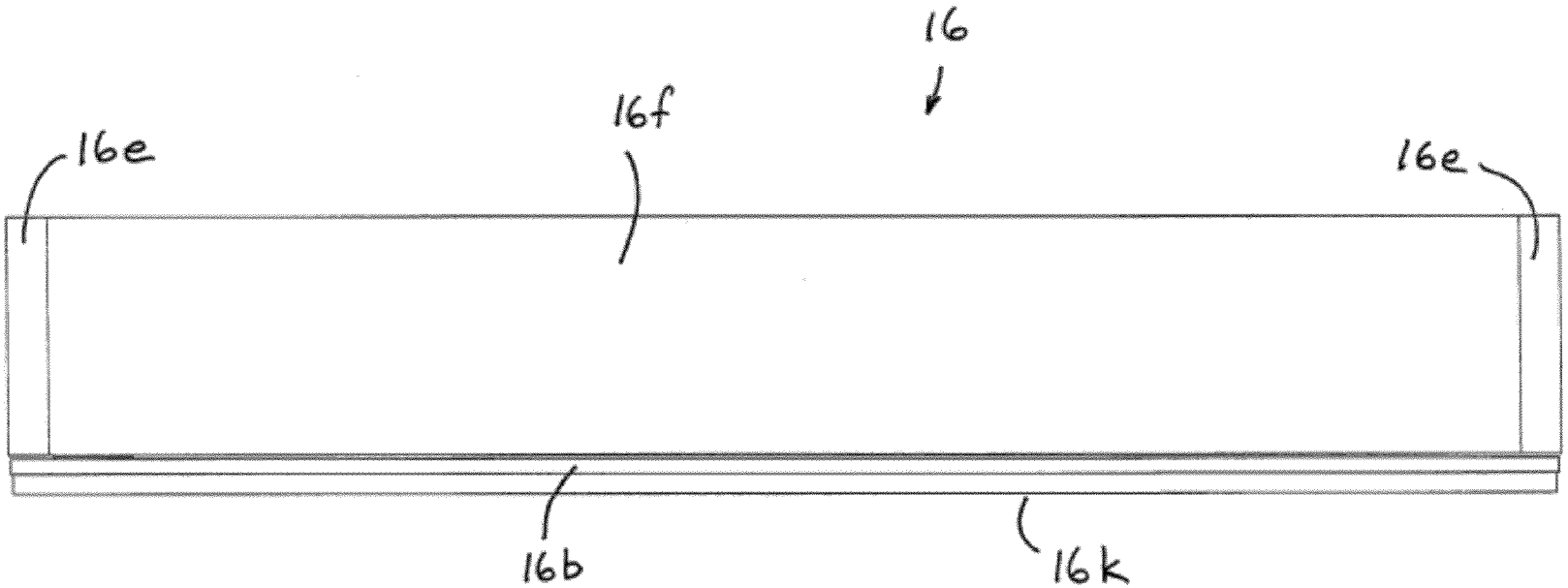
FIG. 13 is a top plan view of the workstation unit of FIG. 10.
Figure 14:
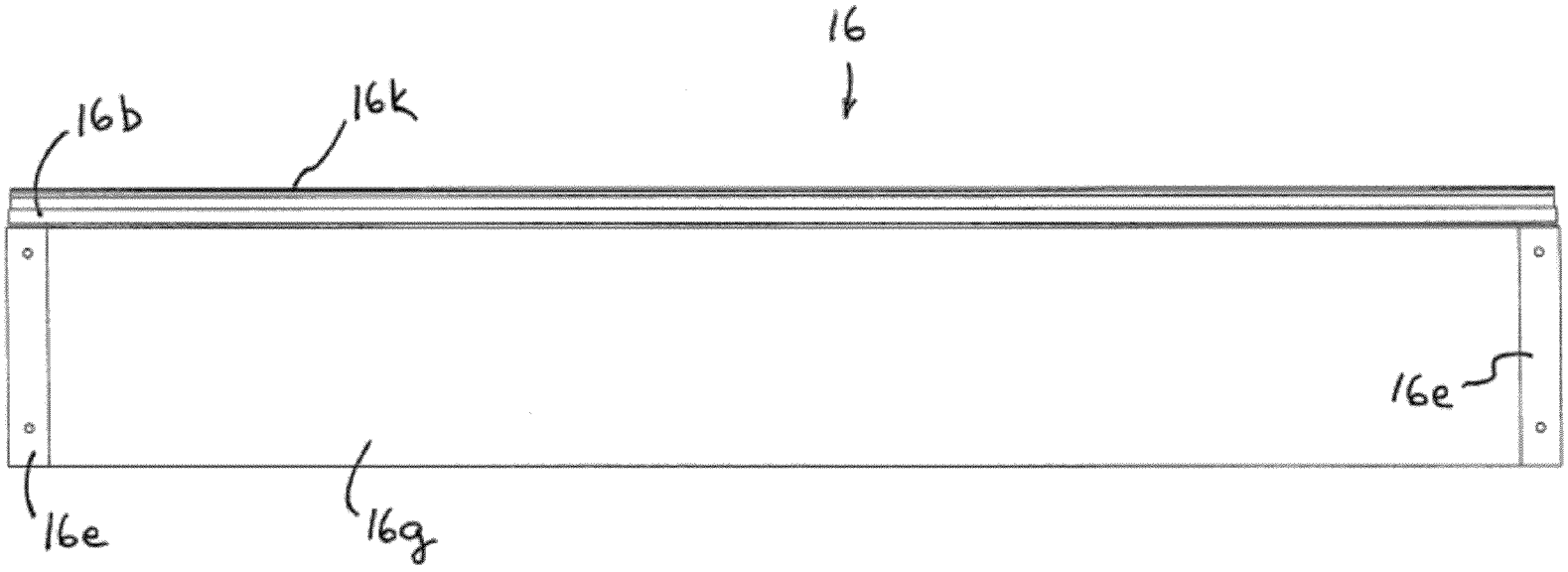
FIG. 14 is a bottom plan view of the workstation unit of FIG. 10.
Figure 15:
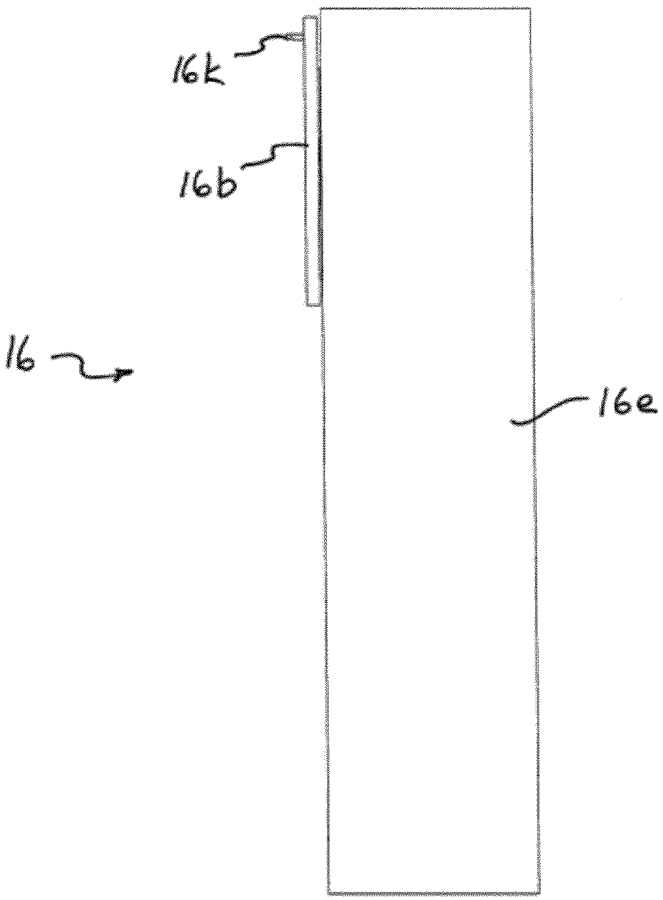
FIG. 15 is a side elevation of the workstation unit of FIG. 10.
Figure 16:
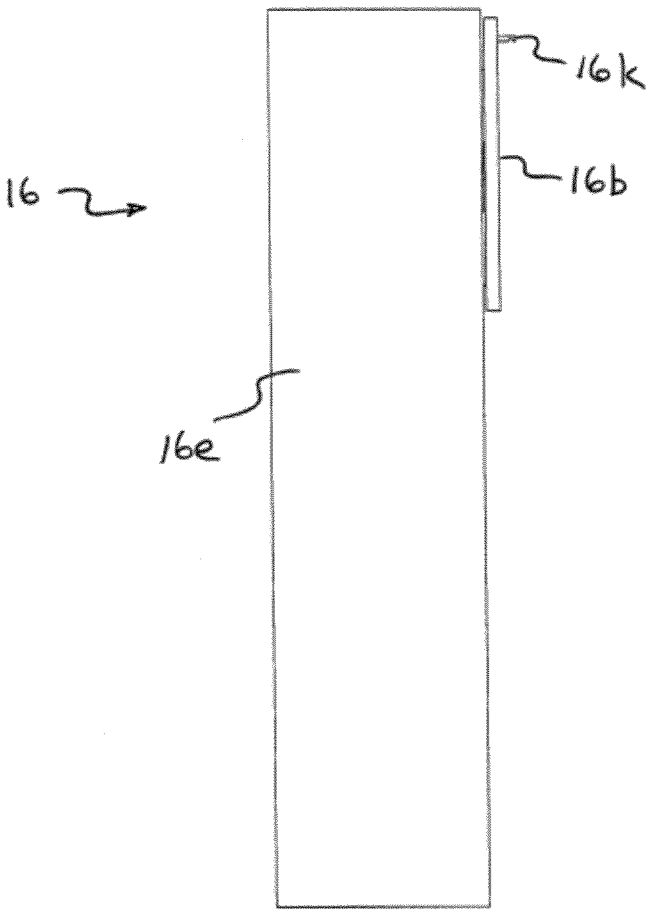
FIG. 16 is an opposite side elevation of the workstation unit of FIG. 10.

This is a narrower area located between the work-in-process zone and the open storage zone (discussed below). Power and data cables can be routed through the work surface grommet to the wire raceway in the wall unit. There may be three (or more or less) back styles available on the wall unit. For example, the wall unit may have a finished back, which provides a clean finished appearance and is recommended when the wall unit is sitting in an open space. Optionally, the wall unit may have an access back, which provides a slot in the back panel to route power and data to the building outlets (such as shown in FIG. 12). Optionally, the wall unit may have an open back, which has a completely open bottom to reduce the redundancy of the back panel against an architectural wall.

Open Storage Zone

This is the lowest part or zone of the wall unit (such as for a taller wall unit, such as a 51 inch tall wall unit or the like) and can be used for less frequently accessed items such as binders, CPU's, paper shredders, laptop bags, trash receptacles and personal effects. This zone may replace the need for overhead storage.

The wall units may be formed to provide any desired finish or appearance. For example, the wall units may be made out of any suitable or desirable material, such as, for example, wood (such as maple, cherry, walnut, rift-cut oak, flat-cut oak, with at least some materials available in various wood finishes), painted MDF, clear anodized aluminum and/or the like.

The wall units may have any suitable edge profile, such as, for example, a square edge or a built-up wood edge. For example, the wall unit may create a substantial feel with a 2 inch built-up wood edge. This 2 inch profile may be carried throughout the components and because the edge is only built-up around the 4 inch perimeter of the work surface, material usage and weight are minimized.

Optionally, the units may have a pull element or handle or the like to assist in opening and closing the various components, including the vertically movable doors or panels. Optionally, the units may include a lock at each door or panel. The wall units may provide any type of storage devices or storage configurations, such as undermount slides with a soft close and self-close mechanism on box drawers, single exterior drawer head on Box/File for a clean aesthetic, painted plywood drawer boxes, and/or the like. Optionally, an aluminum extrusion from the wall unit may be in the drawers to accept work tools.

The wall units may accommodate technology at the work station. For example, power and data cables can be routed through the work surface grommet to the wire raceway in the wall. Optionally, an anodized aluminum wire pass-through may be provided. Optionally, the wall units may include wire management access panels on credenzas, returns and bridges. Optionally, the wall units may include a power station (such as, for example, a PowerPup or the like) as a wall work tool to accommodate power cord plug-in and voice/data jacks or ports. Optionally, the units may provide for equipment storage, such as a laptop/box/file pedestal, a printer pedestal, a power pedestal and/or the like.

Figure 1B:
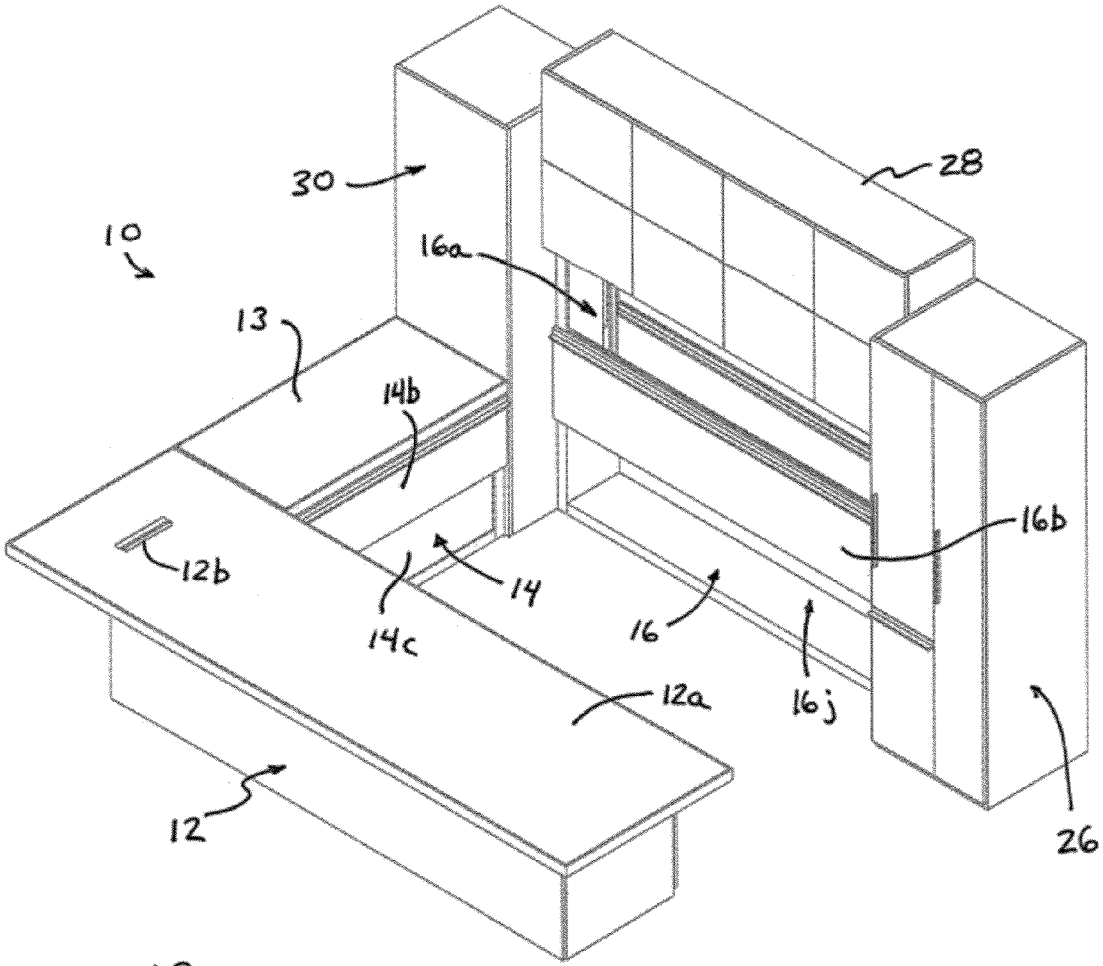
Figure 2:
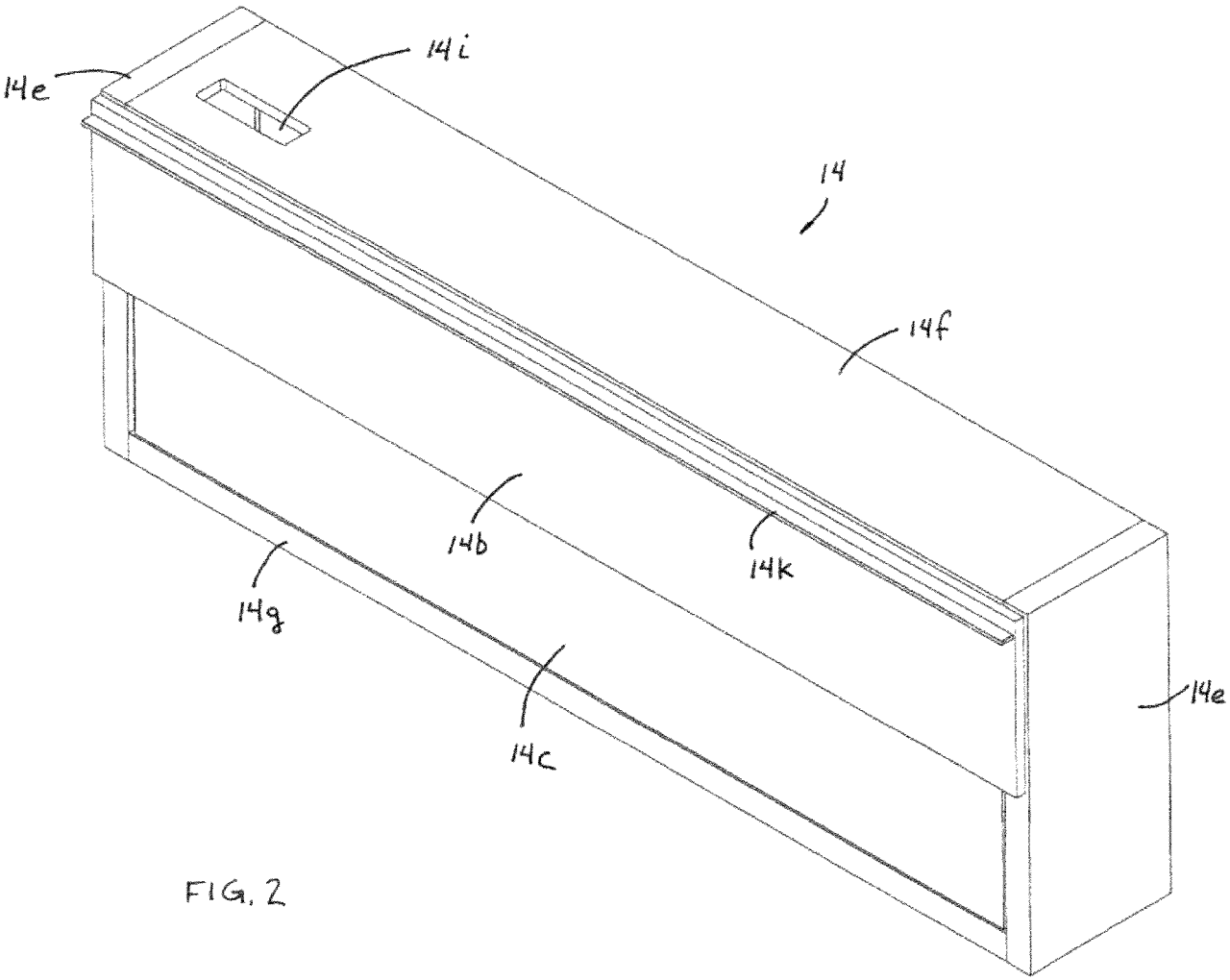
FIG. 2 is a perspective view of a lower profile workstation unit of the office furniture arrangement of FIGS. 1A and 1B, shown in a closed state.
Figure 3:
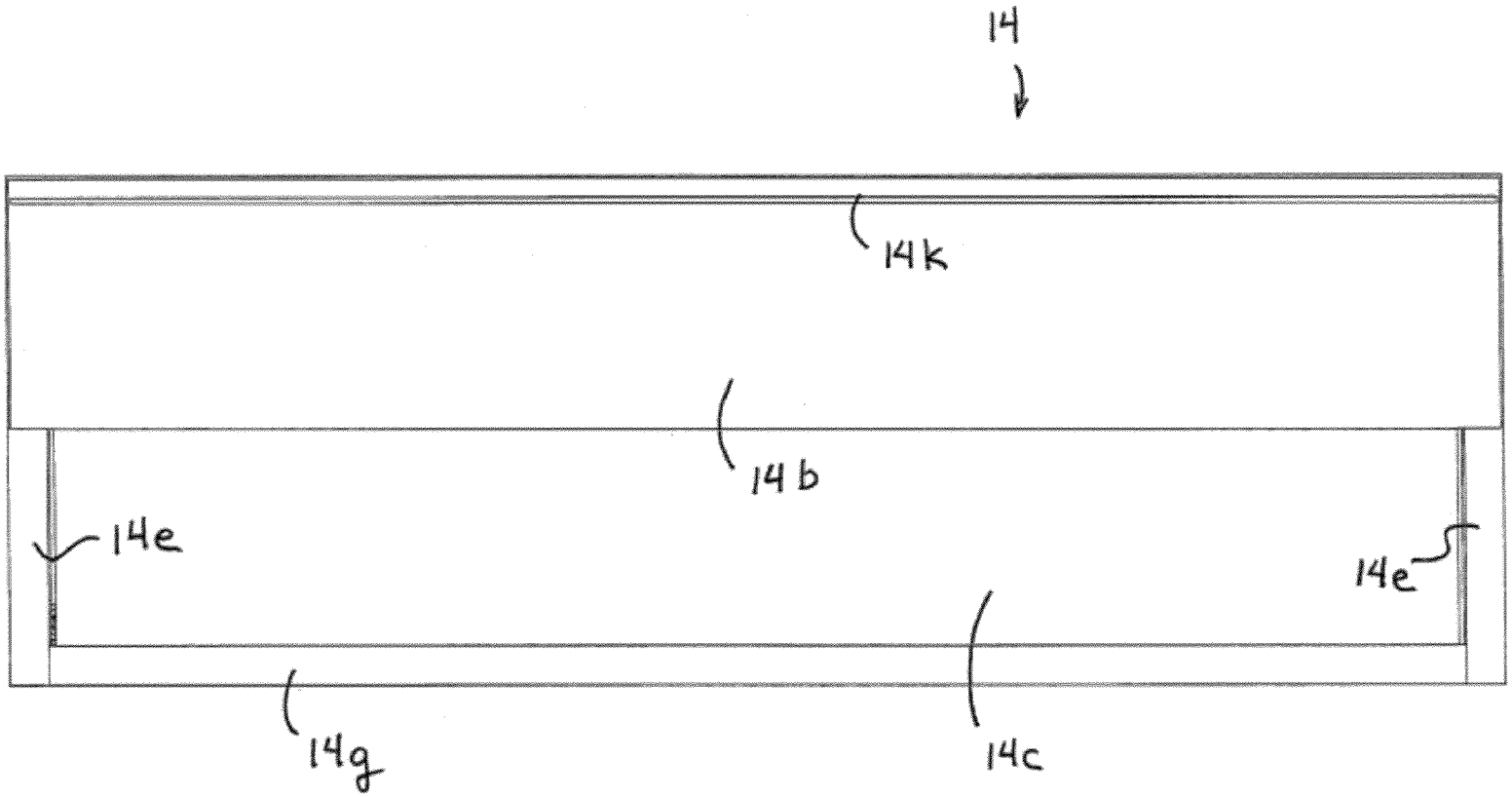
FIG. 3 is a front elevation of the workstation unit of FIG. 2.
Figure 4:
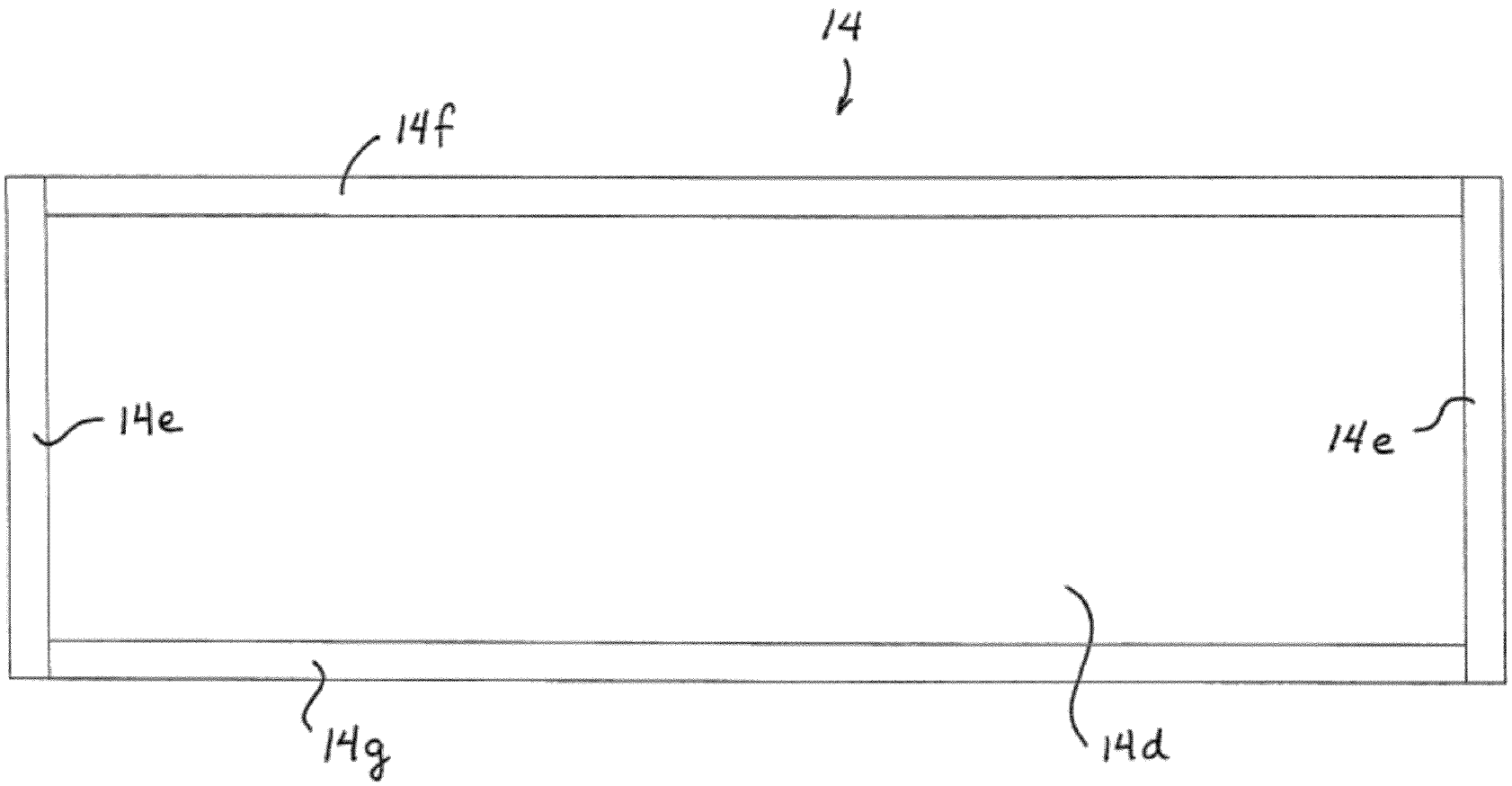
FIG. 4 is a rear elevation of the workstation unit of FIG. 2.
Figure 5:
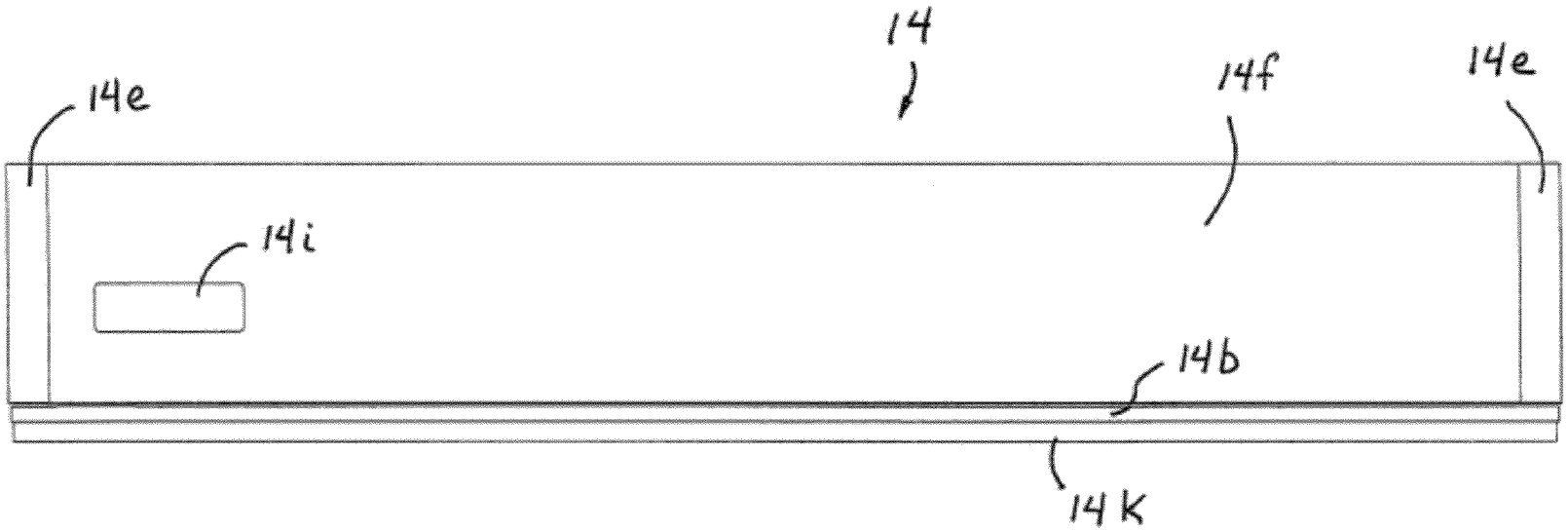
FIG. 5 is a top plan view of the workstation unit of FIG. 2.
Figure 6:
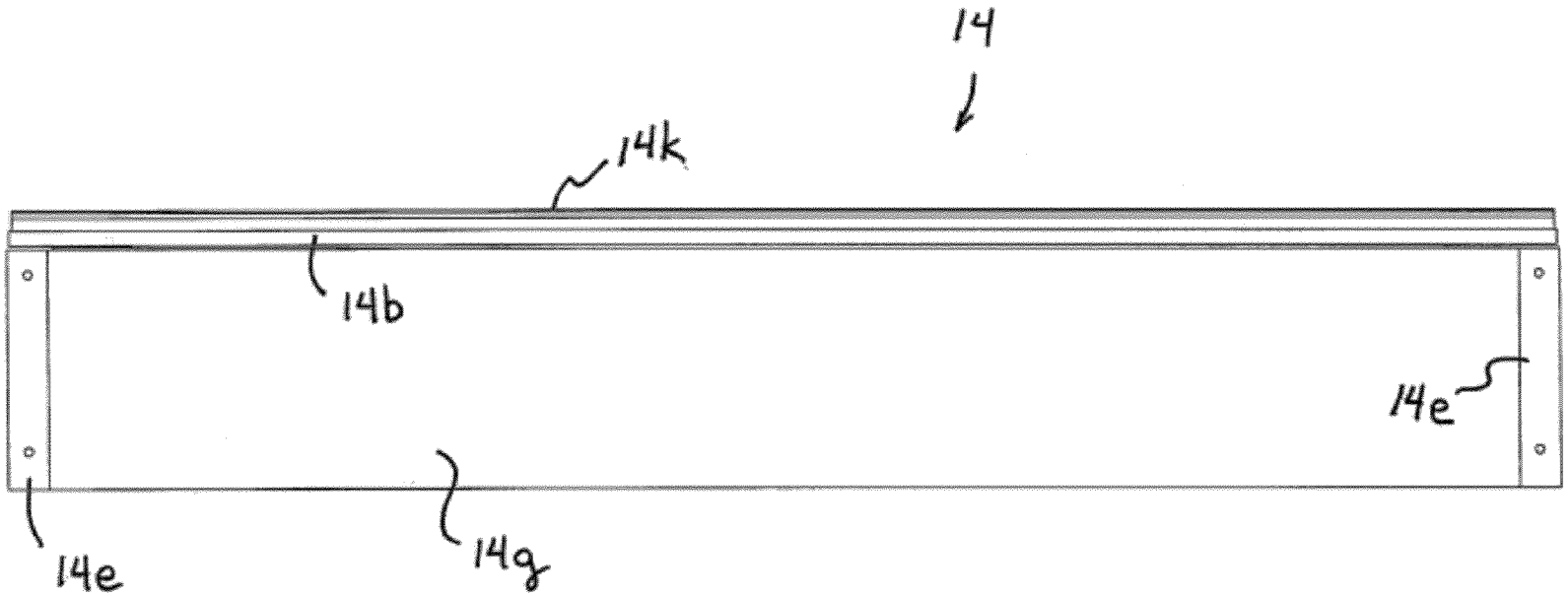
FIG. 6 is a bottom plan view of the workstation unit of FIG. 2.
Figure 7:
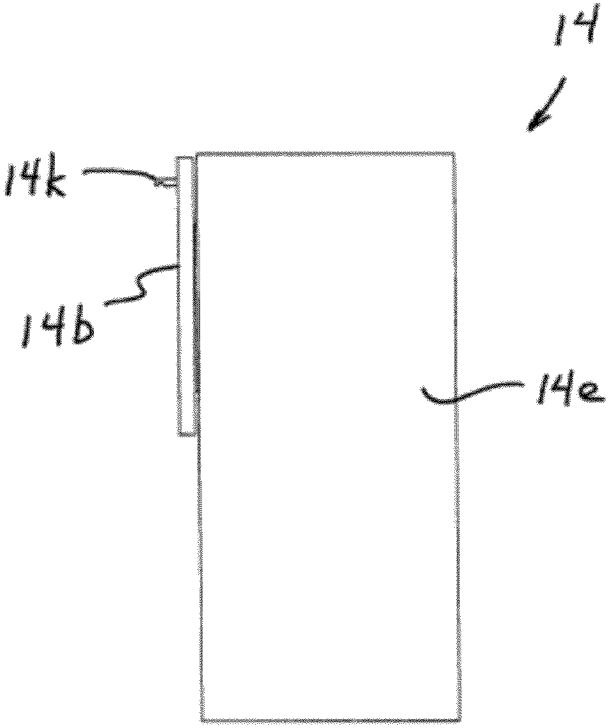
FIG. 7 is a side elevation of the workstation unit of FIG. 2.
Figure 8:
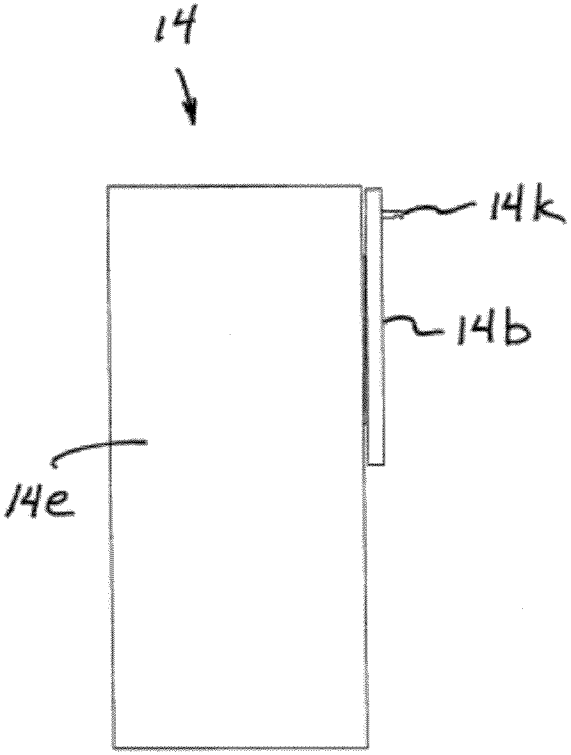
FIG. 8 is an opposite side elevation of the workstation unit of FIG. 2.

For example, and with reference to FIGS. 1A and 1B, a work station assembly or office furniture configuration 10 includes a desk 12, a lower profile workstation unit or wall unit 14 and a higher profile workstation unit or wall unit 16. Desk 12 may comprise any suitable desk or work place and has a work surface 12*a* on which a user may place and spread out work items and/or files while working on a project. In the illustrated embodiment, lower profile workstation unit 14 is adjacent to desk 12 and at a ninety degree angle to the work surface 12*a*, and may have another work surface 13 disposed on top of workstation unit 14 to extend the work surface, while higher profile workstation unit 16 is remote from desk 12 and lower workstation unit 14, whereby the desk, lower profile workstation unit 14 and higher profile workstation unit 16 form a generally U-shaped work area for the user to readily access files at either of the workstation units and to work at either of the work surfaces. However, the workstation units of the present invention may be arranged in a variety of manners depending on the particular work area and desired functions of the units and work area.

Figure 9A:
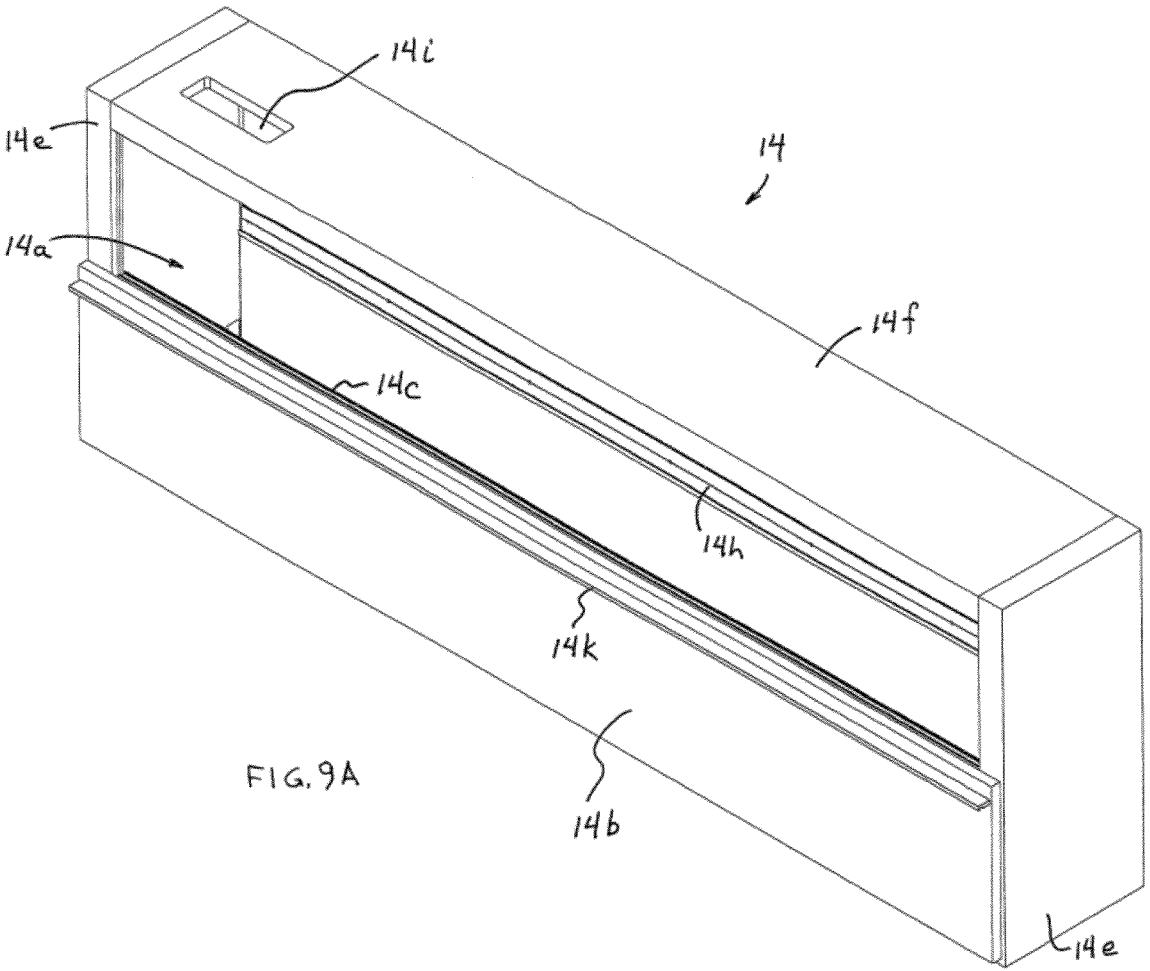
FIGS. 9A and 9B are views of the lower profile workstation unit, shown in an opened state.
Figure 9B:
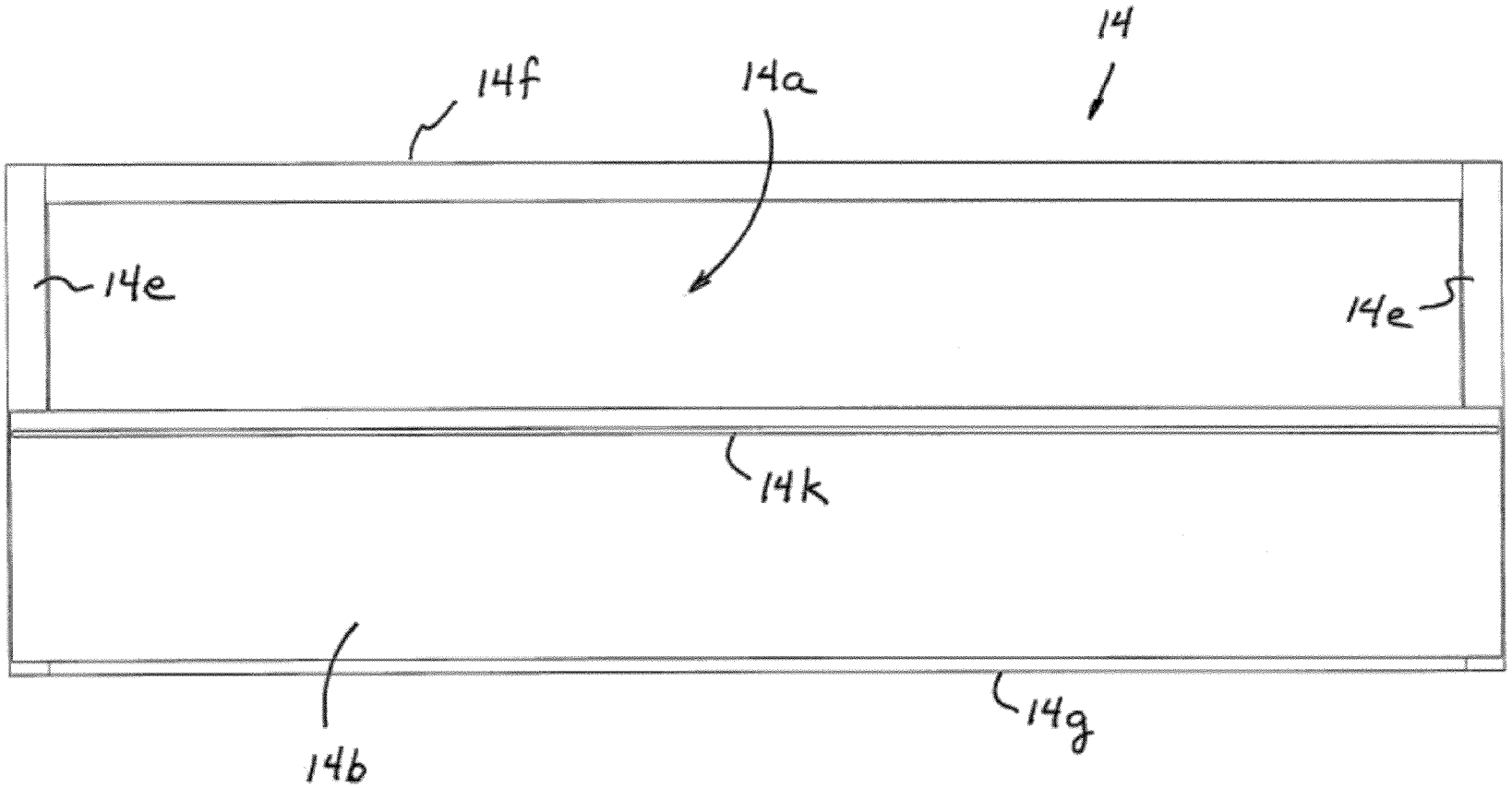
Figure 10:
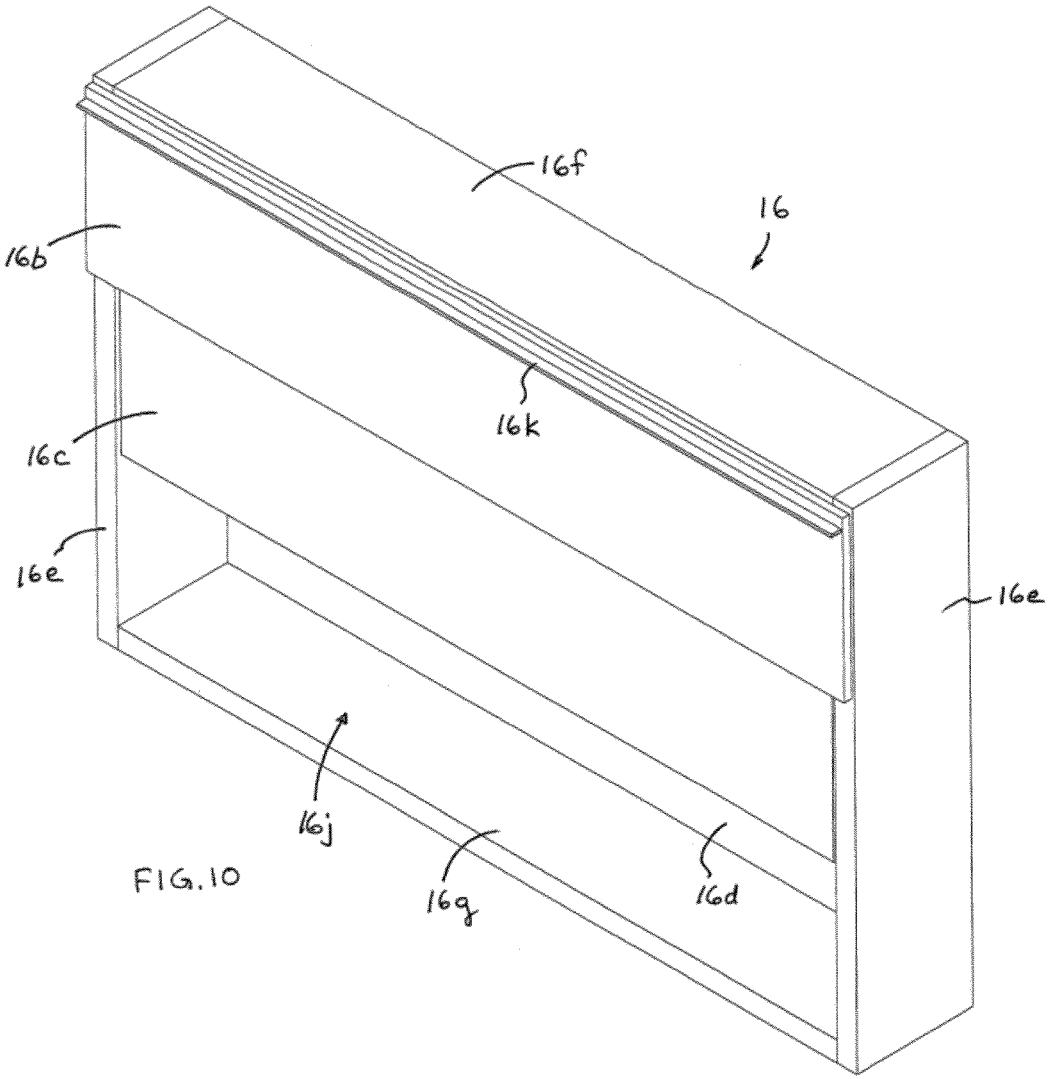
FIG. 10 is a perspective view of a higher profile workstation unit of the office furniture arrangement of FIGS. 1A and 1B.
Figure 11:
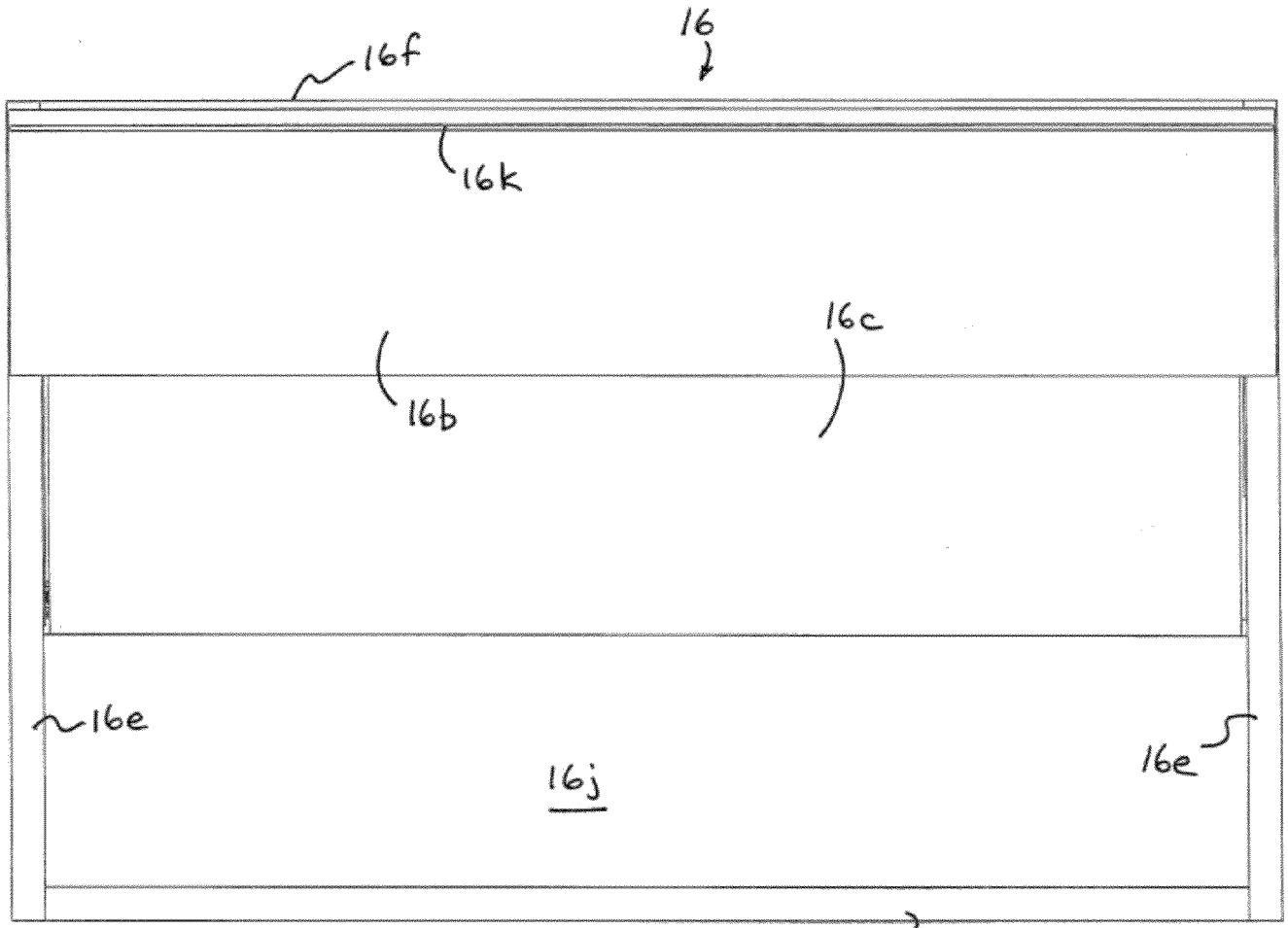
FIG. 11 is a front elevation of the workstation unit of FIG. 10.

Lower profile workstation unit 14 (FIGS. 1-9B) has a storage area or work-in-process zone 14*a* (FIGS. 9A and 9B) for holding or storing files or other work/project items, and includes a vertically moving cover panel 14*b* and a fixed cover panel 14*c*. Fixed cover panel 14*c* is disposed at a lower region of the workstation unit and encloses or conceals the lower region of the storage area 14*a*. Movable cover panel 14*b* is movable between a raised or closed position (FIGS. 1A-8), where the movable cover panel 14*b* closes the upper region of the storage area 14*a* to conceal and secure the work items in the storage area, and a lowered or opened position (FIGS. 9A and 9B), where the upper region of the storage area 14*a* is open and accessible by a user and where the movable cover panel 14*b* is moved downward to overlap or be adjacent to the fixed cover panel 14*c*. A back or rear cover panel 14*d* encloses the storage area 14*a* along the rear of workstation unit 14 and side panels 14*e* enclose the storage area 14*a* along the sides of workstation unit 14 and an upper surface or panel 14*f* and lower surface or panel 14*g* enclose the storage area along the upper and lower regions of the workstation unit, respectively.

Optionally, and desirably, workstation unit 14 may include wire management features, such as a wire raceway or channel 14*h* (FIG. 9A) along and within the workstation unit and a wire grommet or aperture 14*i* at upper surface or panel 14*f* of workstation unit 14 or at the rear panel 14*d* of workstation unit or at fixed cover panel 14*c* or either of the side panels 14*e* of workstation unit, depending on the particular application of the workstation unit. Optionally, the wire management or channel may run or be disposed just below the hanging files or folders in the storage area and along a lower region of the fixed cover panel and storage area, and may have a power strip or the like that can be accessed from above to plug in electrical accessories or other power strips that may then be disposed at the upper portion of the storage area for access by the user when the movable cover panel is opened. In the illustrated embodiment, the wires may be routed through an aperture 14*i* at upper panel 14*f* of lower profile workstation unit 14 and through a wire grommet 12*b* at work surface 12*a* of desk 12, since lower profile workstation unit 14 extends under an end region of the work surface 12*a* of desk 12. A user thus may route wires and cables (such as power and/or communication cables, such as for telephones, computers and/or the like) through the workstation unit to the desired or appropriate locations at the workstation assembly, such as at the work surface 12*a* and/or 13. Optionally, and as shown in FIGS. 1A and 1B, upper panel or work surface 13 may be disposed at the upper panel 14*f* of lower profile workstation unit 14 to provide a substantially continuous L-shaped work surface at desk 12 and lower profile workstation unit 14. However, the upper panel 14*f* may serve as an upper work surface in other applications or configurations, while remaining within the spirit and scope of the present invention.

Figure 17A:
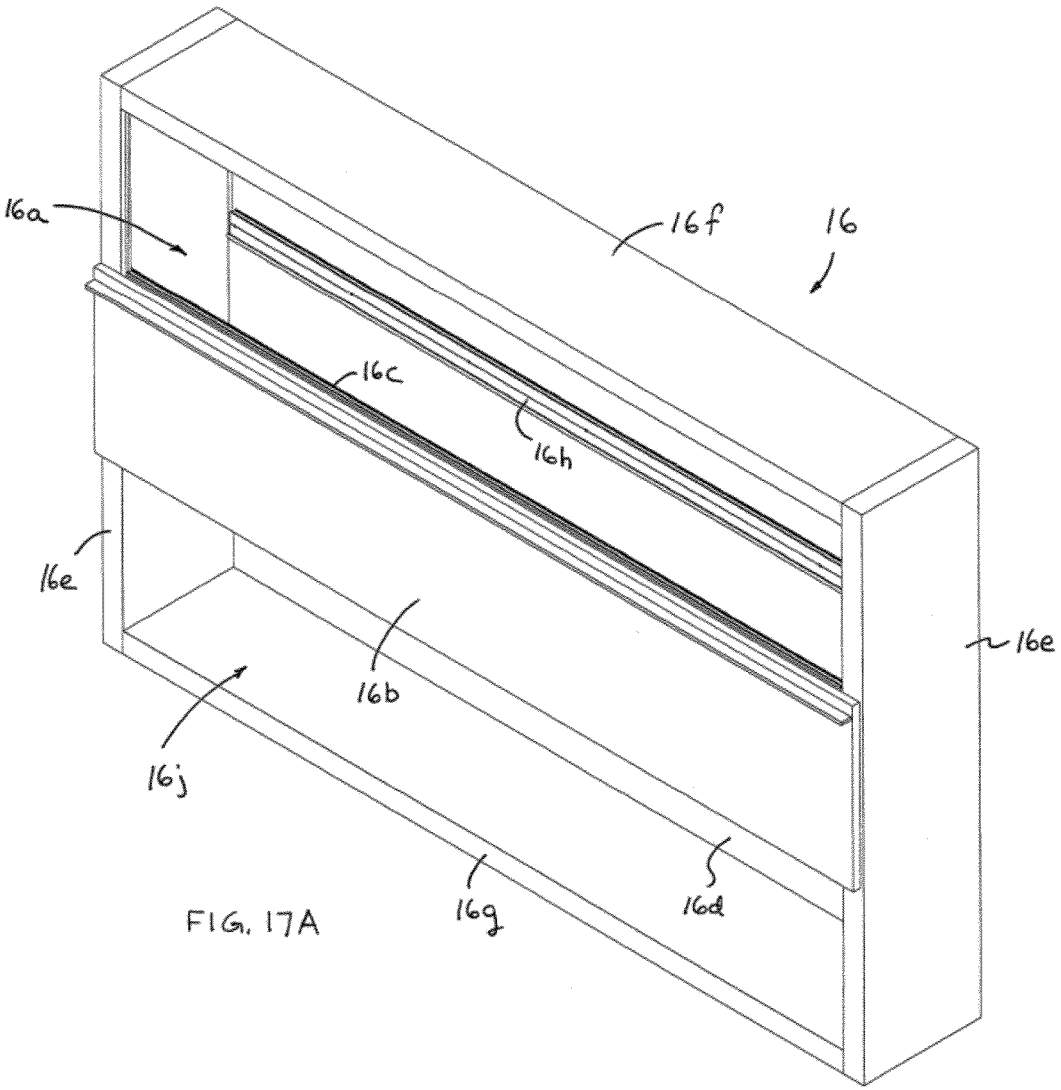
FIGS. 17A and 17B are views of the higher profile workstation unit, shown in an opened state.
Figure 17B:
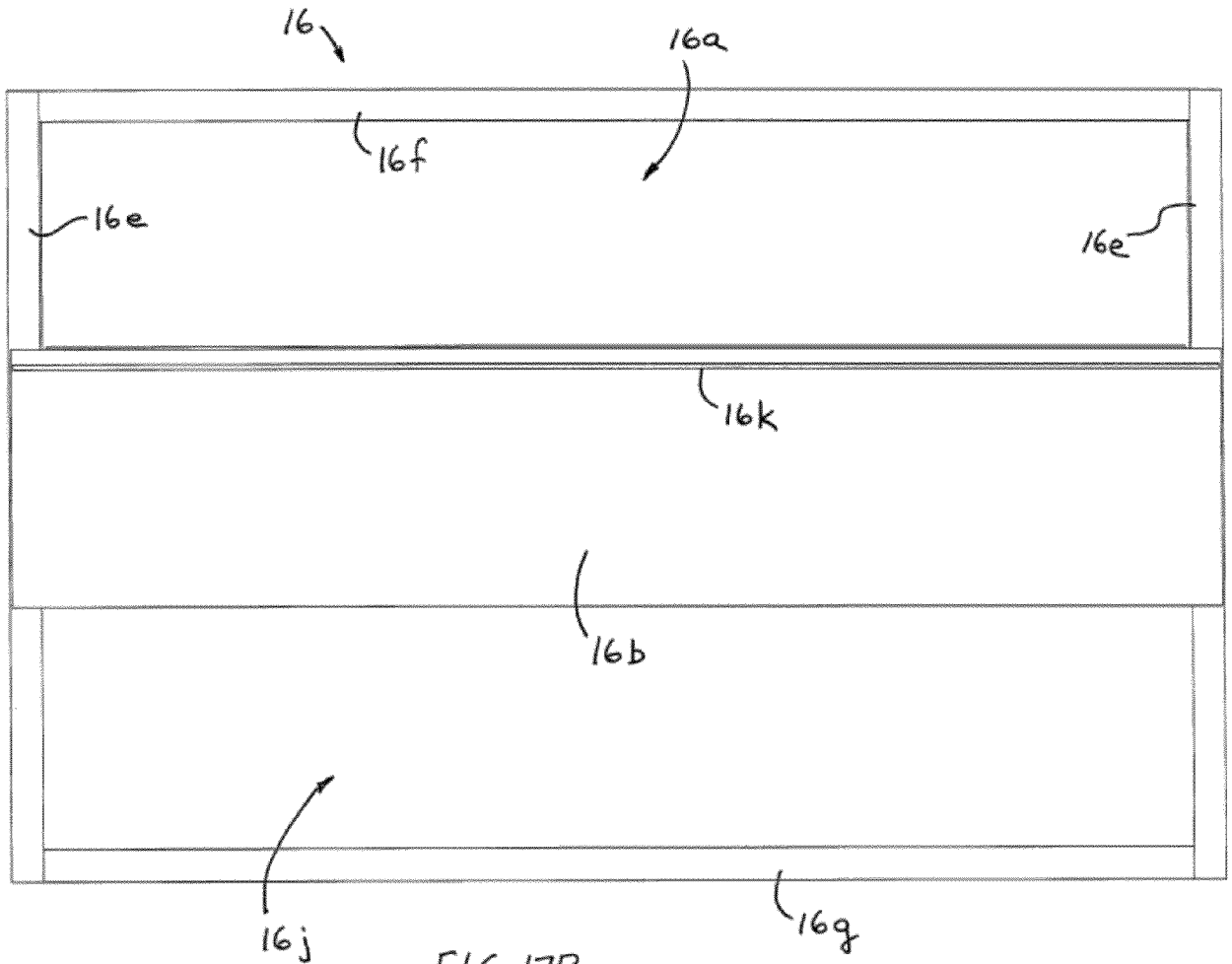

Higher profile workstation unit 16 (FIGS. 1 and 10-17B) includes a storage area or work-in-process zone 16*a* (FIGS. 1B, 17A and 17B) for holding or storing files or other work/project items, and has a vertically moving cover panel 16*b* and a fixed cover panel 16*c*. Fixed cover panel 16*c* is disposed at a middle region of the workstation unit and encloses the lower region of the storage area 16*a*. Movable cover panel 16*b* is movable between a raised or closed position (FIGS. 1A and 10-16), where the movable cover panel 16*b* closes the upper region of the storage area 16*a* to conceal and secure the work items in the storage area, and a lowered or opened position (FIGS. 1B, 17A and 17B), where the upper region of the storage area 16*a* is open and accessible by a user and where the movable cover panel 16*b* is moved downward to overlap or be adjacent to the fixed cover panel 16*c*.

Higher profile work station 16 includes a back or rear cover panel 16*d* that encloses the storage area 16*a* along the rear of the workstation unit 16, and includes an upper surface or panel 16*f* and side panels 16*e* and a lower surface or panel 16*g*. Optionally, and desirably, workstation unit 16 may include wire management features, such as a wire raceway or channel 16*h* along and within the workstation unit and a wire aperture and/or grommet at the upper surface or panel 16*g* of workstation unit 16 and/or a wire aperture and/or grommet 16*i* at the rear panel 16*d* of workstation unit or at fixed cover panel 16*c* or either of the side panels 16*e* of workstation unit, depending on the particular application of the workstation unit, such as discussed above with respect to lower profile workstation unit 14. Higher profile workstation unit 16 includes an open storage area 16*j* below storage area 16*a* and below fixed cover panel 16*c* for storing other items below the work-in-process zone, such as for items that are not often needed. Optionally, storage area 16*a* may be bounded at its lower end region by a lower panel, or the lower region of the storage area may be open, since the storage area may support pendaflex files and/or hanging files and the like, which typically do not need a lower panel beneath them.

Thus, the workstation units 14, 16 allow for storage of work-in-process files or project items at a location where they are readily accessible for the person to access them and extract them for use or work (and without having to get up and go to a remote filing cabinet or the like). In order to access the project items in the storage area, the user may readily move or slide the movable cover panel downward to open the storage area, whereby the user may readily access the files or items within the opened storage area. When it is desired to store the files or conceal the files or secure the files (such as if a meeting is being held in the user's office or such as at the end of the work day), the user may readily move or slide the movable cover panel upward to close the storage area. The movable cover panel may slide easily, and may be retained in its upper or closed position via any suitable retaining means, such as via frictional retention or a latch or lock or the like.

In the illustrated embodiments, the movable cover panels 14*b*, 16*b* are slidable or movable along the forward or front edges of the side panels and are proud of or project outward from the respective side panels and top and bottom panels of the workstation units. The movable cover panels may be movable or slidable along tracks or rails that extend along the respective side panels of the workstation units. In the illustrated embodiments, the movable cover panels 14*b*, 16*b* include a handle portion or grasping element 14*k*, 16*k* to assist the user in grasping and moving the panel to the desired position along the workstation unit and fixed cover panel.

Figure 18:
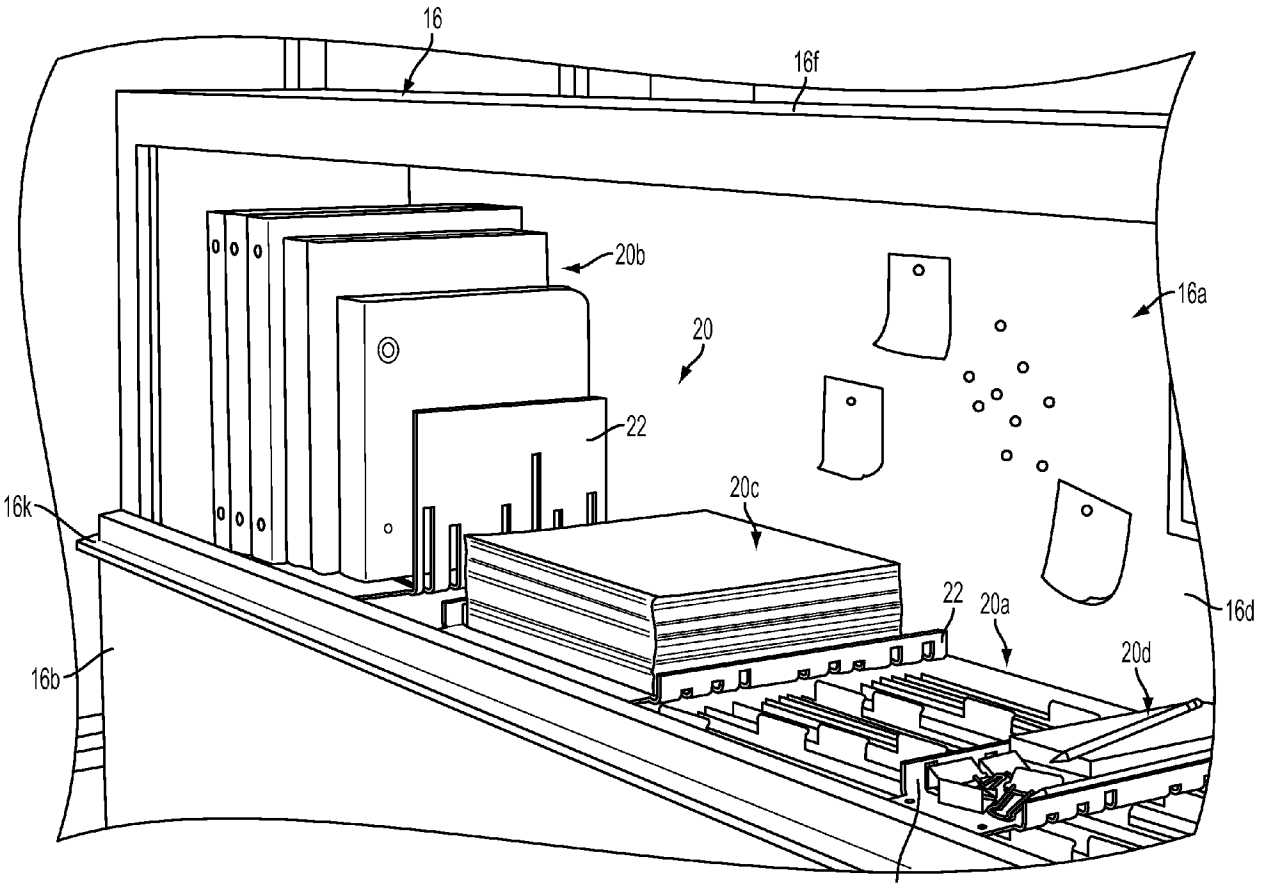
FIG. 18 is a perspective view of the storage area and stored items of a workstation unit of the present invention, shown in an opened state.

Optionally, for example, and with reference to FIG. 18, the storage area 16*a* of workstation unit 16 may support various work related files or folders or items 20. In the illustrated embodiment the work related items include hanging files or folders 20*a* that hang from a plurality of rails or bars or rods extending across the workstation unit and between fixed cover panel 16*e* and rear panel 16*d* of workstation unit 16. The files thus are supported behind fixed cover panel 16*c* at the lower portion of storage area 16*a*, and are accessible from above when the movable cover panel 16*b* is in its opened position (as shown in FIG. 18). Optionally, one or more upper supports 22 (which may be slidable or movable along rails extending along the fixed cover panel and the rear panel of the workstation unit) may be provided for supporting other work related items, such as folders or books 20*b* or paper 20*c* or office supplies 20*d*, such as pens, pencils, paper clips or the like, at the upper portion of storage area 16*a*, whereby the items 20*b*, 20*c*, 20*d* are readily viewable and accessible by the user when the movable cover panel 16*b* is in its opened or lowered position and are hidden from view when the movable cover panel 16*b*, is in its closed or raised position.

Optionally, the rear panel 16*d* of workstation unit 16 may include a corkboard or magnetic board or substrate or other suitable substrate or panel at its interior surface so as to allow a user to post various notes or items at the rear of the storage area, such as shown in FIG. 18. Optionally, the workstation unit 16 may include a light or illumination source at or under upper panel 16*f* to provide illumination of the work items 20 to enhance their viewability and accessibility. The light may be automatically activated when the movable cover panel is moved to its opened position or may be selectively activated by a user using the workstation unit.

Figure 19:
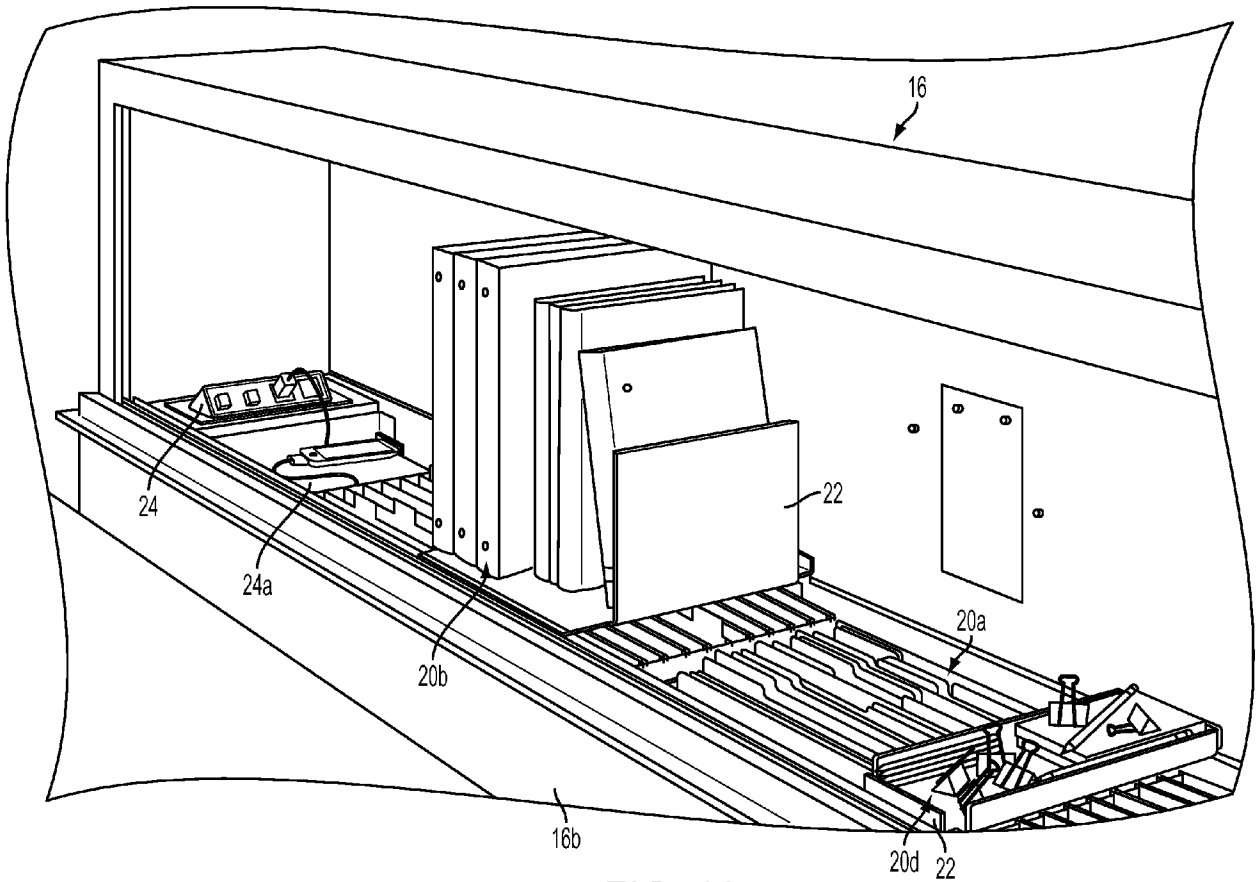
FIG. 19 is another perspective view of the storage area and stored items of a workstation unit of the present invention, showing a power station at the storage area.

Optionally, and as shown in FIG. 19, the workstation unit may include a power station 24, which provides one or more power outlets and/or communication ports or the like, for the user to plug various electronic accessories into as desired. The power station 24 may include a support shelf 24*a* for supporting an accessory (such as a PDA or the like) that may be charging or otherwise connected to the power station. In the illustrated embodiment, the power station 24 is at an end region of the workstation unit and generally at the level of the upper edge of the fixed cover panel so that the outlets or communication or data ports may be readily accessed by the user when the movable cover panel is in its opened position.

Thus, a person may be sitting at a chair at their work station and may work at their desk. While working on various projects, the person may readily access files or folders or the like pertaining to their work-in-process by opening the movable cover panel of the workstation unit and accessing and/or removing the desired or appropriate file or folder or item. When the person is done working on the project, or if other persons enter the room and it is desired to have a clean conference setting, the person may put the work items back in the storage area of the workstation unit and close the movable cover panel, thereby concealing and/or securing the work items within the workstation unit. The work-in-process files or items are thus temporarily stored in an enclosed environment where they can be readily accessed, yet are not visible when not in use, thereby limiting or substantially precluding unsightly and bothersome file piles on the person's desk or work surface.

In the illustrated embodiment of FIGS. 1A and 1B, work station assembly 10 is arranged in a generally U-shaped configuration, with higher profile workstation unit 16 extending along and behind and spaced from desk 12. Optionally, and as shown in FIGS. 1A and 1B, other storage units may be added to the work station assembly, such as a tall cabinet 26 at one or both ends of one or both of the workstation units, or overhead cabinets 28 (disposed at the upper panel of the workstation unit 16), or a wardrobe panel 30 (with a hook for hanging a coat or jacket behind the panels and within a space defined by the L-shaped panels and the structural wall of the office or facility), and/or any other suitable office furniture options.

Figure 20:
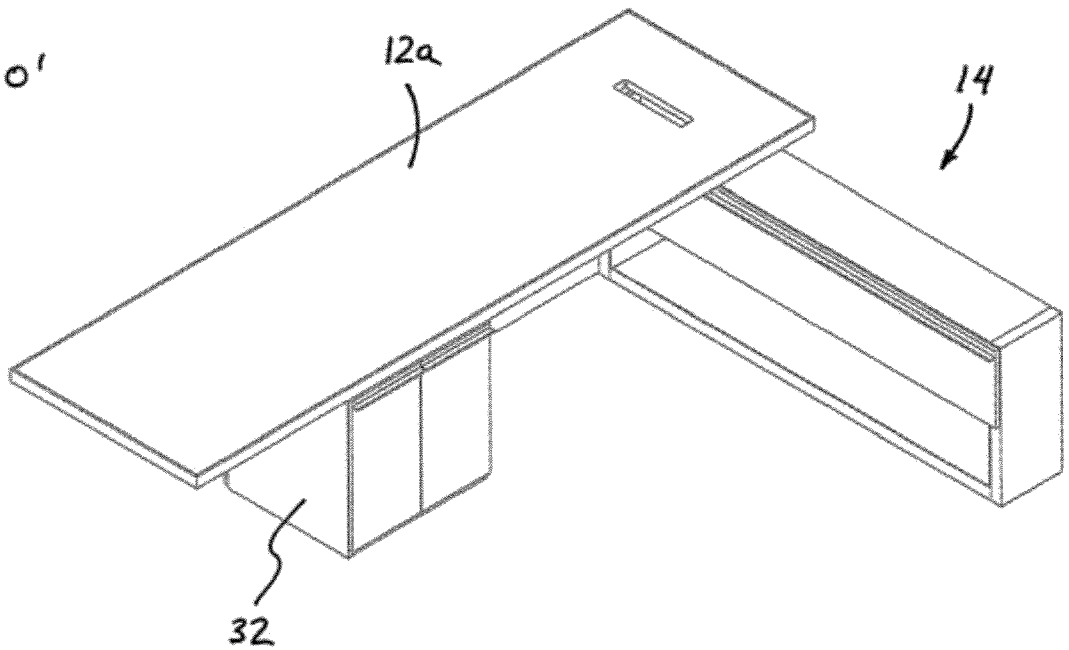
FIGS. 20 and 21 are views of another workstation assembly or office furniture configuration in accordance with the present invention.
Figure 21:
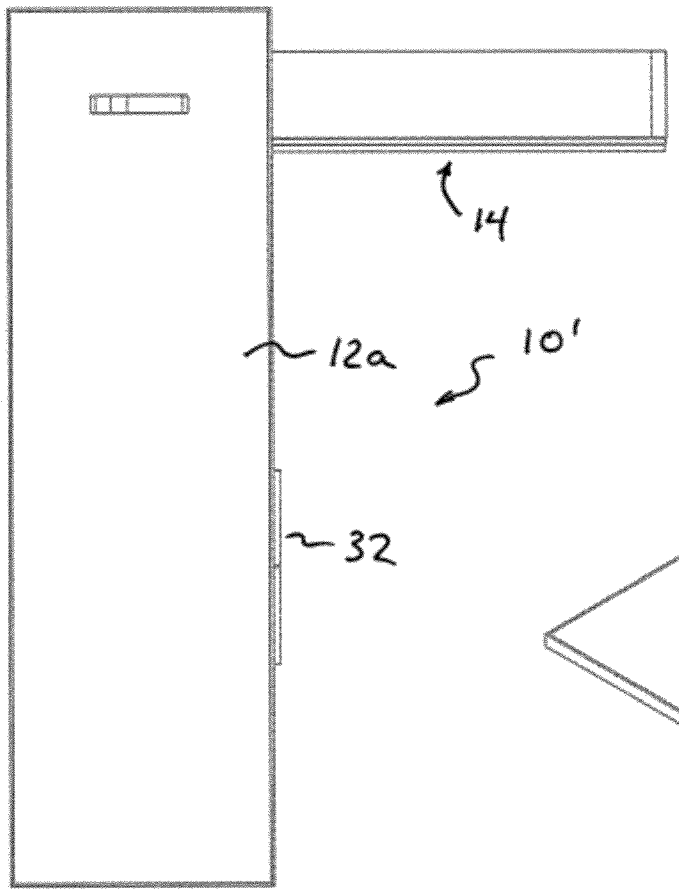

Optionally, other office configurations may be suitable for the workstation units of the present invention. For example, and with reference to FIGS. 20 and 21, a work station assembly 10' may include a lower profile workstation unit 14 disposed at and supporting one end of a work surface 12*a*, while a cabinet or pedestal 32 may support the other end of the work surface. The pedestal 32 may provide drawers or file storage or computer storage or the like, depending on the particular application of the work station assembly.

Figure 22:
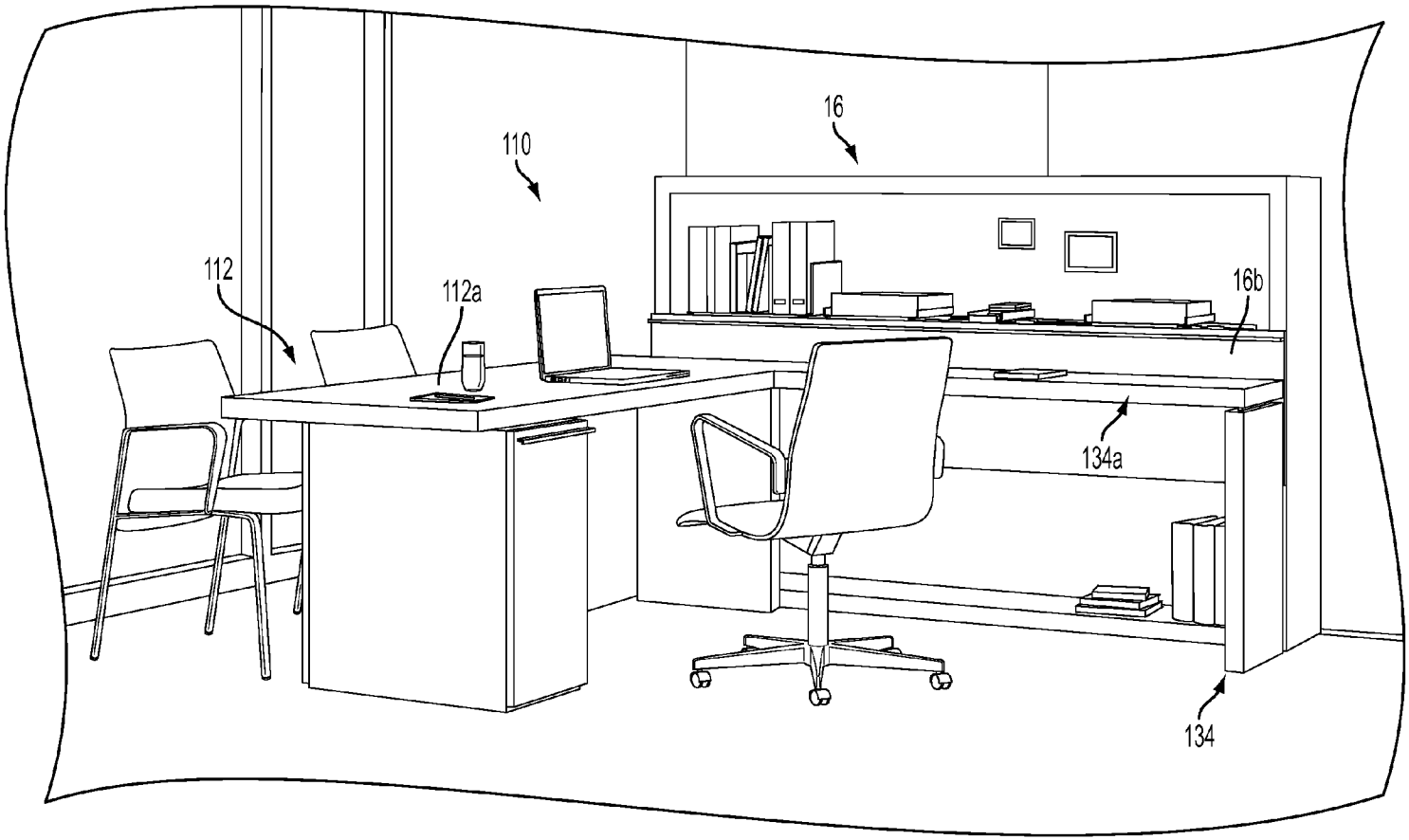
FIG. 22-24 are perspective views of another workstation assembly or office furniture configuration in accordance with the present invention.

Optionally, for example, and with reference to FIG. 22, a desk 112 and a higher profile workstation unit 16 may be arranged transverse to one another to form an L-shaped work station assembly 110. A narrow or shallow shelf or desk portion 134 (such as a twelve or fourteen inch wide shelf) may be disposed along the workstation unit 16 and may have a narrow or shallow work surface 134*a* that is at the level of the work surface 112*a* of the desk 112, and may be at a level below that of an upper edge of the fixed cover panel of workstation unit 16 (for example, the fixed cover panel (or the movable cover panel when in its lowered or opened position) may provide a wall that extends about three to four inches or thereabouts above the adjacent work surface). The movable cover panel 16*b* of workstation unit 16 may move between its upper closed position and a lowered opened position (as shown in FIG. 22), where the movable cover panel may be disposed between the fixed cover panel and the narrow shelf 134 and work surface 134*a* (and moving along a gap between the work surface and the fixed cover panel that may be established via a mounting bracket that attaches the narrow shelf structure to the workstation unit and creates and maintains the desired or appropriate gap between the fixed cover panel and the work surface). The user thus may sit next to the work surface and the wall or fixed panel extends upward from and adjacent to the work surface, where the work-in-process items are readily accessible when the movable cover panel is moved or lowered to its opened position.

Figure 23:
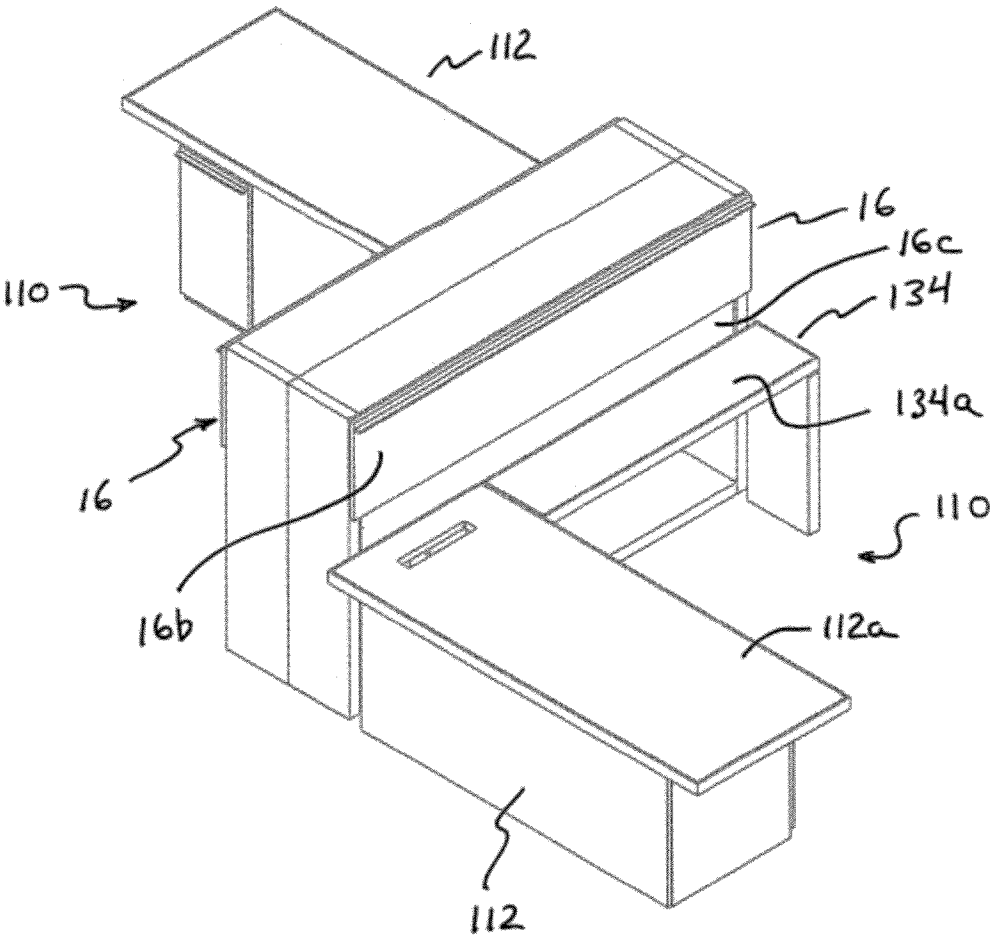
Figure 24:
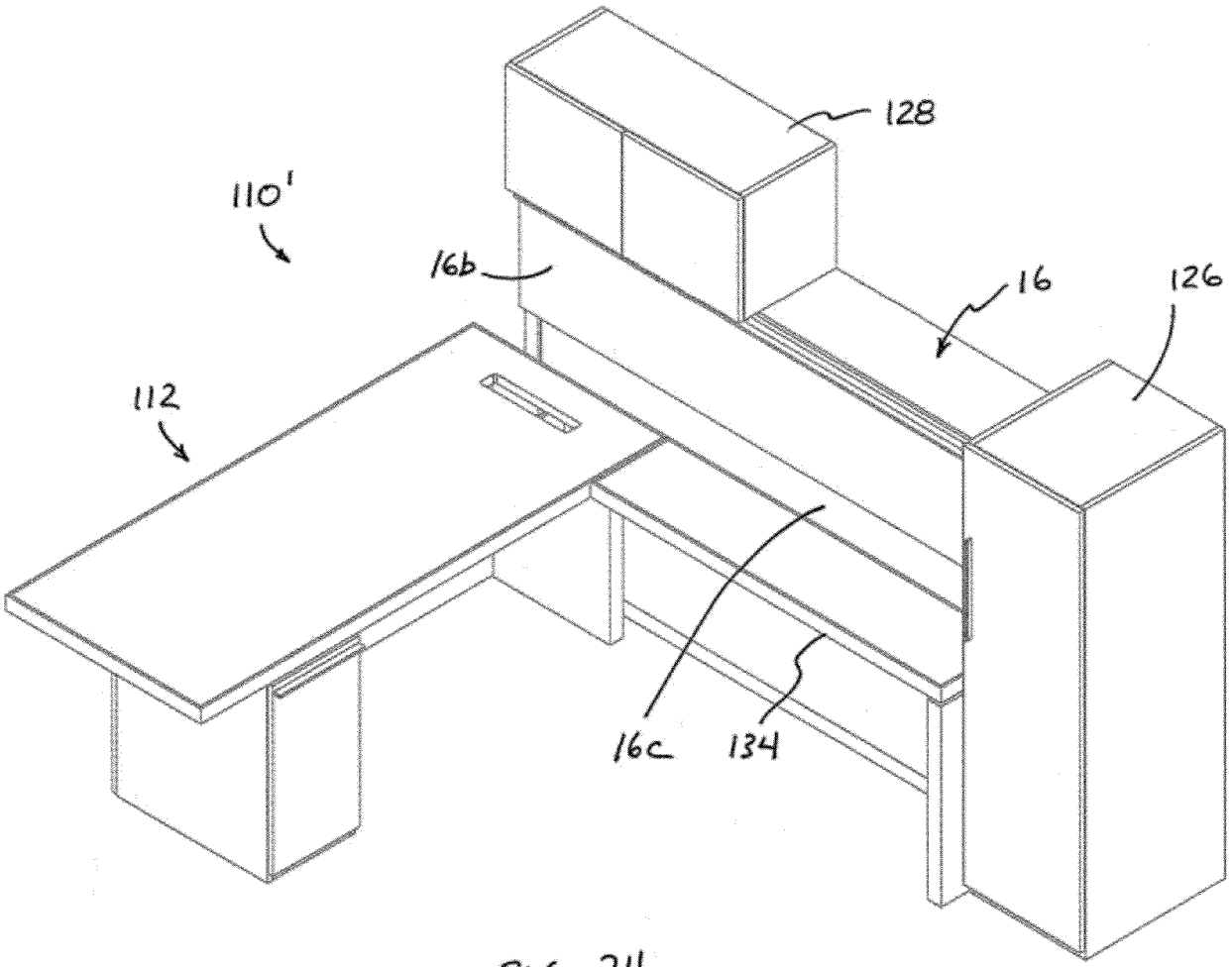

Optionally, and with reference to FIG. 23, two L-shaped work station assemblies 110 may be arranged with the higher profile workstation units 16 back-to-back, but could be otherwise arranged or configured while remaining within the scope of the present invention. For example, and with reference to FIG. 24, an L-shaped work station assembly 110' may include a desk 112 and higher profile workstation 16 and narrow shelf or desk portion 134, as discussed above, and may have overhead cabinets 128 disposed at or over workstation unit 16 and a tall storage cabinet 126 disposed at or adjacent to workstation unit 16. Clearly, other configurations are contemplated within the spirit and scope of the present invention.

Thus, the wall units of the present invention locate work-in-process within immediate reach while lightweight vertical sliding doors provide concealment of work files and the like. The work tools may be provided in multiple styles and material options satisfy a wide range of needs. Optional laptop/box/file pedestals may provide convenient storage and concealment of the user's laptop freeing up valuable work surface space. Optional wardrobe panels provide cost effective, minimalist approach to concealment of outerwear. Numerous optional footprint capabilities ensure that the work stations are adaptable to a broad range of space requirements. Freestanding, L-Shape, Side U-Shape, and Back U-Shape configurations—with or without the wall unit—provide ample application diversity.

Changes and modifications to the specifically described embodiments may be carried out without departing from the principles of the present invention, which is intended to be limited only by the scope of appended claims as interpreted according to the principles of patent law including the doctrine of equivalents.

The invention claimed is:

1. A work station unit comprising:

a work surface;

a storage area for storing project files at or near said work surface;

a fixed cover panel disposed at a lower portion of said storage area to define a front wall of said storage area and at least partially conceal the project files stored in said lower portion of said storage area; and a movable cover panel that is vertically movable between an opened position, where at least a portion of said storage area is exposed and accessible for accessing the project files that are stored in said lower portion of said storage area and at least partially concealed by said fixed cover panel, and a closed position, where an upper portion of said storage area is at least substantially concealed by said movable cover panel, wherein said movable cover panel at least partially overlaps said fixed cover panel when in said opened position.

2. The work station unit of claim 1, further comprising a wire management portion below said storage area.

3. The work station unit of claim 2, wherein said wire management portion comprises at least one of an open area and an area concealed by a fixed panel.

4. The work station unit of claim 2, wherein said movable cover panel is moved to be at least partially over and generally at said wire management portion when in its opened position.

5. The work station unit of claim 1, wherein said storage area is configured to support hanging folders with said upper portion of said storage area being open above said hanging folders.

6. The work station unit of claim 5, wherein said fixed cover panel at least partially conceals said hanging folders, while said movable panel conceals said upper portion of said storage area above said hanging folders when in said closed position and reveals said upper portion of said storage area above said hanging folders when in said opened position.

7. The work station unit of claim 6, further comprising at least one support element for supporting project items above said hanging folders and in said upper portion of said storage area.

8. The work station unit of claim 1, wherein said movable cover panel is movable along an outer surface of said fixed cover panel.

9. The work station unit of claim 1, wherein an upper edge region of said fixed cover panel is at a level that is above a level of said work surface.

10. The work station unit of claim 1, further comprising an open storage area below said fixed cover panel, and wherein said open storage area is not closed by said movable cover panel in either of said opened and closed positions.

11. A work station assembly comprising:

a work surface comprising a generally horizontal work surface;

a workstation unit comprising:

a storage area for storing project files along and generally adjacent to a perimeter edge region of said work surface, wherein said storage area is configured to support project items with an upper portion of said storage area above the project items;

a fixed cover panel disposed at a lower portion of said storage area to define a front wall of said storage area and at least partially conceal the project items disposed at said lower portion of said storage area, wherein an upper edge region of said fixed cover panel is at a level that is above a level of said work surface; and a movable cover panel that is vertically movable between an opened position, where said upper portion of said storage area is at least partially exposed and wherein the project items disposed at said lower portion of said storage area and at least partially concealed by said fixed cover panel are accessible by a user of said work station unit, and a closed position, where said upper portion of said storage area is at least substantially concealed by said cover panel.

12. The work station assembly of claim 11, wherein said movable cover panel conceals said upper portion of said storage area when in said closed position and wherein said movable cover panel at least partially overlaps said fixed cover panel when said movable cover panel is in said opened position.

13. The work station assembly of claim 12, wherein said movable cover panel is movable along an outer surface of said fixed cover panel.

14. The work station assembly of claim 11, wherein said workstation unit is adjacent to and extends along a rear edge region of said work surface.

15. The work station assembly of claim 11, wherein said workstation unit comprises an open storage area below said fixed cover panel, and wherein said open storage area is not closed by said movable cover panel in either of said opened and closed positions.

16. The work station assembly of claim 11, wherein said workstation unit comprises support elements for supporting hanging files, said support elements extending between said fixed cover panel and a rear panel of said workstation unit, wherein said hanging files are disposed in said lower portion of said storage area and substantially encompassed by said fixed cover panel.

17. The work station assembly of claim 16, wherein said workstation unit comprises accessory supports for supporting accessories at said upper portion of said storage area.

18. The work station assembly of claim 16, wherein said workstation unit comprises a power station that is at least partially above said support elements so as to be accessible at said upper portion of said storage area when said movable cover panel is in said opened position.

19. The work station assembly of claim 11, wherein said workstation unit comprises a wire management portion below said storage area.

20. The work station assembly of claim 19, wherein said movable cover panel is moved to be at least partially over and generally at said wire management portion when in its opened position.

* * * * *

UNITED STATES PATENT AND TRADEMARK OFFICE

CERTIFICATE OF CORRECTION

PATENT NO. : 8,205,950 B1
APPLICATION NO. : 12/479098
DATED : June 26, 2012
INVENTOR(S) : Robert J. Bockheim and Joel T. Ruiter It is certified that error appears in the above-identified patent and that said Letters Patent is hereby corrected as shown below:

Column 7
Line 65, "16e" should be --16c--

Signed and Sealed this
Thirtieth Day of October, 2012

David J. Kappos

David J. Kappos
*Director of the United States Patent and Trademark Office*